US009523201B2

(12) United States Patent
Romanenko

(10) Patent No.: US 9,523,201 B2
(45) Date of Patent: Dec. 20, 2016

(54) CONSTRUCTION COMPONENTS HAVING EMBEDDED INTERNAL SUPPORT STRUCTURES TO PROVIDE ENHANCED STRUCTURAL REINFORCEMENT FOR, AND IMPROVED EASE IN CONSTRUCTION OF, WALLS COMPRISING SAME

(71) Applicant: Sergei V. Romanenko, Milford, NH (US)

(72) Inventor: Sergei V. Romanenko, Milford, NH (US)

( * ) Notice: Subject to any disclaimer, the term of this patent is extended or adjusted under 35 U.S.C. 154(b) by 0 days.

(21) Appl. No.: 14/885,685

(22) Filed: Oct. 16, 2015

(65) Prior Publication Data

US 2016/0076246 A1 Mar. 17, 2016

Related U.S. Application Data

(63) Continuation-in-part of application No. 14/485,618, filed on Sep. 12, 2014, now Pat. No. 9,194,125.

(51) Int. Cl.
*E04C 5/06* (2006.01)
*E04B 1/04* (2006.01)
(Continued)

(52) U.S. Cl.
CPC . *E04C 5/06* (2013.01); *E04B 1/04* (2013.01); *E04B 2/34* (2013.01); *E04B 2/36* (2013.01);
(Continued)

(58) Field of Classification Search
CPC ..... E04C 1/39; E04C 5/06; E04C 5/0627; E04C 2002/048; E04C 2002/046; E04C 2002/045;E04B 1/043; E04B 1/04; E04B 1/4114; E04B 1/215; E04B 2001/2415; E04B 2002/0254; E04B 2003/021
(Continued)

(56) References Cited

U.S. PATENT DOCUMENTS 1,779,755 A * 10/1930 Smith ..... E04B 2/22 52/284
2,140,283 A * 12/1938 Faber ..... E04C 5/06 52/378
(Continued)

FOREIGN PATENT DOCUMENTS

JP 2003201717 A * 7/2003 ..... E02D 27/01

*Primary Examiner* — Brent W Herring

(57) ABSTRACT

A construction component provides structural reinforcement of structures built therewith, by embedding an internal support structure within a substrate component such as a cast concrete block during fabrication of the construction component. The embedded internal support structure can include interface plates that are structurally coupled to the internal support structure and are made accessible outside of the substrate to permit the internal support structures of the individual construction components to be mechanically tied together in constructing a structure therewith. The internal support structure can be triangular, and can be coupled together using threaded bolts, rivets or welds. The substrate block is formed with vertical channels to provide access to the interface plates of components being coupled during construction. Wall structures may be constructed through standard, non-standard and specialty components of the invention to create an integrated internal reinforcement lattice that permeates the wall structure, and that can be coupled to a foundation to create structures having superior lateral reinforcement.

42 Claims, 20 Drawing Sheets

(51) Int. Cl.

| | |
|---|---|
| ***E04C 1/40*** | (2006.01) |
| ***E04B 2/34*** | (2006.01) |
| ***E04B 2/36*** | (2006.01) |
| ***E04B 2/46*** | (2006.01) |
| ***E04C 1/39*** | (2006.01) |
| ***E04C 1/41*** | (2006.01) |
| *E04B 2/02* | (2006.01) |

(52) U.S. Cl.
CPC ..... *E04B 2/46* (2013.01); *E04C 1/397* (2013.01); *E04C 1/40* (2013.01); *E04C 1/41* (2013.01); *E04B 2002/0202* (2013.01); *E04B 2002/0206* (2013.01); *E04B 2002/0263* (2013.01); *E04B 2002/0265* (2013.01)

(58) Field of Classification Search
USPC ..... 52/565, 562, 563, 600, 601, 438, 569
See application file for complete search history.

(56) References Cited

U.S. PATENT DOCUMENTS

RE20,980 E * 1/1939 McMillan ..... E04C 5/06 52/261
2,199,152 A * 4/1940 Edge ..... E04B 1/168 29/897.31
2,444,133 A * 6/1948 Groat ..... E04B 2/14 52/22
2,577,323 A * 12/1951 Goenner ..... E04B 2/58 52/274
2,920,475 A * 1/1960 Graham ..... B28B 23/0006 249/13
2,963,828 A * 12/1960 Belliveau ..... E04B 2/08 52/564
2,969,619 A * 1/1961 Didrick ..... E04C 2/34 52/285.2
3,296,758 A * 1/1967 Knudsen ..... E04B 2/10 52/223.7
3,369,334 A * 2/1968 Berg ..... E04B 1/06 52/223.13
3,785,097 A * 1/1974 Seymour ..... E04G 21/14 52/126.7
4,018,021 A * 4/1977 Dow ..... E04B 1/04 52/251
4,080,765 A * 3/1978 Fasano ..... E04B 1/06 403/153
4,121,398 A * 10/1978 Hahn ..... E04B 1/19 52/600
4,569,167 A * 2/1986 Staples ..... E04B 1/04 52/285.4
4,761,929 A * 8/1988 Zeigler ..... E04H 15/34 52/646
5,560,167 A * 10/1996 Miceli ..... E04C 1/40 52/204.2
5,862,639 A * 1/1999 Abou-Rached ..... B28B 11/04 264/274
6,058,672 A * 5/2000 McClellan ..... E04B 1/04 52/309.12
6,065,263 A * 5/2000 Taguchi ..... E04B 5/023 403/305
6,237,297 B1 * 5/2001 Paroly ..... E04C 2/06 52/309.4
6,915,614 B2 * 7/2005 Matsufuji ..... E04B 2/42 52/285.2
6,935,075 B2 * 8/2005 Sherman ..... E04C 2/384 446/108
7,934,345 B2 * 5/2011 Marsh ..... E02D 29/025 52/223.7
8,141,320 B2 * 3/2012 Colonias ..... E04C 5/06 52/293.3
8,448,397 B2 * 5/2013 Tincher ..... E04B 1/4114 249/83
8,646,239 B2 * 2/2014 Rulon ..... E04B 2/50 52/223.7
8,850,763 B2 * 10/2014 Marsh ..... E04B 2/16 52/223.7
9,206,597 B2 * 12/2015 Marsh ..... E04B 2/16
2004/0020145 A1 * 2/2004 Matsufuji ..... E04B 2/42 52/223.7
2005/0252123 A1 * 11/2005 Colonias ..... E04C 5/06 52/295
2007/0186502 A1 * 8/2007 Marsh ..... E04B 2/16 52/604
2008/0098687 A1 * 5/2008 Marsh ..... E04B 2/16 52/606
2008/0216445 A1 * 9/2008 Langer ..... E04B 2/8647 52/745.09
2009/0100790 A1 * 4/2009 Matsufuji ..... B28B 7/183 52/745.19
2011/0107716 A1 * 5/2011 Foley ..... E04B 1/2403 52/699
2011/0138735 A1 * 6/2011 Foley ..... E04B 1/4114 52/699
2011/0283647 A1 * 11/2011 Fang ..... E04B 2/16 52/565
2012/0110943 A1 * 5/2012 Ally ..... E04B 1/4128 52/582.1
2013/0326984 A1 * 12/2013 Litaize ..... E04B 1/043 52/426
2015/0167294 A1 * 6/2015 Ally ..... E04B 1/4128 52/700

* cited by examiner

CONSTRUCTION COMPONENTS HAVING EMBEDDED INTERNAL SUPPORT STRUCTURES TO PROVIDE ENHANCED STRUCTURAL REINFORCEMENT FOR, AND IMPROVED EASE IN CONSTRUCTION OF, WALLS COMPRISING SAME

CROSS-REFERENCE TO RELATED APPLICATION

This application is a Continuation-in-Part of application Ser. No. 14/485,618 filed Sep. 12, 2014 and entitled "A BUILDING BLOCK CONSTRUCTION COMPONENT HAVING EMBEDDED INTERNAL SUPPORT STRUCTURES TO PROVIDE ENHANCED STRUCTURAL REINFORCEMENT AND IMPROVED EASE OF CONSTRUCTION THEREWITH," and which is incorporated in its entirety herein by this reference.

FIELD OF THE INVENTION

This application relates generally to construction components, and more particularly to construction components that are structurally enhanced internally.

BACKGROUND OF THE INVENTION

Pre-manufactured cast concrete blocks of various designs have been used in the construction industry for many years. One commonly employed concrete block design is often referred to as a CMU (Concrete Masonry Unit). Typically, a bed of mortar is manually applied over the blocks, which are then hand set and aligned into the mortar in a staggered fashion to create mortar joints therebetween. The construction is therefore highly labor intensive. The CMU is sized to balance ease in handling and the ability to construct walls of various shapes, with being large enough to reduce the total number of manual operations required in constructing those walls. While the size of a CMU varies internationally, the most common nominal size is 16 inches×8 inches×8 inches (about 410 mm×200 mm×200 mm).

Because concrete is strong in compression, but relatively weak in tension, concrete is often structurally reinforced to compensate for this structural imbalance. Thus, CMUs are typically made with hollow channels, sometimes referred to as voids or cores, that permit the deployment of steel rebar (reinforcement bar) there through. Because the blocks are staggered, the channels or voids overlap from one layer to another, permitting rebar to extend from the top of the wall to the bottom. The rebar is typically secured within the voids using grout or concrete.

While this technique of reinforcement can be effective to internally reinforce a constructed wall, the reinforcement process, when combined with the process of actually laying the blocks is highly labor intensive, time consuming, and therefore costly. Furthermore, variations in environmental conditions as well as the skill of the masons during construction, can lead to inconsistencies in the quality of a completed wall.

In an attempt to lower the cost of construction, the construction industry has also employed building blocks that are much larger in size than the CMU. However, as the size of concrete blocks increase, they have tendency to become brittle, thereby necessitating reinforcement. To further reduce construction costs, the larger prefabricated blocks are sometimes pre-fabricated with internal reinforcement materials already built into the block during fabrication. Not only does this render the pre-reinforced blocks more difficult to handle and transport, but the reinforcement materials are neither interconnected, nor are they directly coupled to external structures used to create overall stability of the walls. This lack of integration can result in overuse of such reinforcement material to achieve a wall of a desired strength.

It should be further pointed out that while the geometry of CMUs and other concrete blocks is favorable for providing reinforcement in vertical and horizontal planes, walls constructed of such blocks still tend to have low resistance to sheer stress, which makes them less than ideal for seismically-resistant construction.

SUMMARY OF THE INVENTION

The construction component of the present invention provides structural reinforcement of structures built therewith, by including an internal support structure that is embedded within a substrate component such as a cast concrete block, during fabrication of the construction component. The component can include interface plates that are structurally coupled to the internal support structure to permit the internal support structures of the individual construction components to be mechanically tied together in constructing a structure therewith. Thus, the internal support structures of the individual components can be coupled together without the need for labor intensive and inconsistent conventional mortar joints, as well as to provide an interconnected lattice of internal reinforcement throughout the structure that eliminates the need to add what is otherwise an inferior form of structural reinforcement conventionally added to the structure on site.

An embodiment of a construction component of the invention provides internal structural reinforcement embedded during its fabrication. The internal structural reinforcement is configured to be directly coupled to the embedded internal reinforcement of others of the construction component the construction component. The internal support structure includes at least one triangular structure, with the at least one triangular structure being formed of a base member and two congruent side members. The members of the triangular shaped structure form a first base vertex between a first one of the congruent members and the base member, a second base vertex between the second congruent member and the base member, and an elevated vertex formed by the first and second congruent members opposite of the base member. The internal support structure also includes at least one elevated interface plate that is structurally coupled to the congruent members at the elevated vertex, and a first and second base interface plate, with the first base interface plate being coupled to the first one of the congruent members and the base member at the first base vertex and the second base interface plate being coupled to the second one of the congruent members and the base member at the second base vertex. The construction component further includes a cast concrete block substantially surrounding the internal support structure, with the elevated interface plate of the internal support structure being exposed through a top surface of the concrete block, the first and second base interface plates being exposed through a bottom surface of the concrete block. The elevated interface plates of the construction component is configured to be mechanically coupled to one of the base interface plates of each of at least two others of the construction components to securely couple the construction components together in a staggered manner.

In an embodiment, the congruent members and base member of the at least one triangular structure are composed of steel rebar.

In a further embodiment, the at least one triangular structure is composed of a unitary piece of pressed metal. In other embodiments, the base interface plates are bent to form right angles to the two congruent and base members respectively.

In further embodiments the cast concrete block includes at least a first and second vertical channel, each extending from the top surface to the bottom surface of the concrete block, and disposed over the base interface plates to provide access to the base interface plates from the top surface.

In a further embodiment, the base interface plates include at least one opening there-through, each of the vertical channels disposed directly over the at least one opening of each of the base interface plates. The upper interface plate includes at least two threaded openings, wherein the at least one opening of each of the base interface plates of a first one of said construction components is configured to be aligned with at least one of the at least two threaded openings of the elevated interface plate of a second one of said construction components such that a threaded bolt can be inserted through the at least one opening of the base interface plate and screwed into the at least one of the at least two threaded bolts to mechanically couple the first one and second one of the construction components together.

In further embodiments, a third one of the construction components can be coupled in a staggered manner to the second one of the construction components along with the first one of the construction components by screwing a threaded bolt through the at least one opening of the third one of the construction components into a remaining at least one of the at least two threaded openings of the elevated interface plate of the second one of the construction components.

In still further embodiments, the construction components can be mechanically coupled to a second one of the interface components by riveting the base plate of the first construction component to the elevated interface plate of the second interface component through the vertical channel of the first construction component.

In other embodiments, a first one of the construction components can be mechanically coupled to a second one of the interface components by welding the base plate of the first construction component to the elevated interface plate of the second interface component through the vertical channel of the first construction component.

In an embodiment, the first and second base plates are formed a single L-shaped bar. In other embodiments, the internal support structure includes two of the triangular structures disposed substantially in parallel with one another, and the concrete block includes at least a first and second vertical channel disposed over the base interface plates of each of the two triangular structures. In a further embodiment, the first and second base plates of each of the two triangular structures are formed of a single U-shaped bar.

In another embodiment, the internal support structure includes two or more instantiations of the two triangular structures disposed in parallel, each of the instantiations including additional members that are coupled between the elevated interface plates of the two or instantiations.

In further embodiments, the at least one triangular structure further includes a vertical member extending from the upper vertex to a point on the base member that is substantially half way between the two base vertices, and a support plate that is structurally coupled to the triangular structure at a point beneath the intersection between the vertical member and the base member.

In an alternate embodiment, the internal support structure further includes one or more additional members that are cross-coupled between the base vertices of the two triangular structures. The internal support structure can further include one or more additional members that are cross-coupled between the elevated vertex of at least one of the two triangular structures to at least one of the base vertices of the other of the two triangular structures of the internal support structure.

In one embodiment, the cast concrete block has the dimensions of a CMU (concrete masonry unit).

In further embodiments, building a structure from a plurality of the construction components creates an interconnected internal support structure lattice throughout the structure.

In other aspects of the invention, a construction component of invention includes an internal support structure that includes at least two triangular structures, each being formed of a base member and two congruent side members to establish a first base vertex between a first one of the congruent members and the base member, a second base vertex between the second congruent member and the base member, an elevated vertex formed by the first and second congruent members opposite of the base member. The internal support structure further includes at least one member cross-coupled between a first and second one of the at least two triangular structures. The internal support structure further includes at least one elevated interface plate being structurally coupled substantially at the elevated vertex of each of the at least two triangular structures, as well as at least one first and at least one second base interface plate, the at least one first base interface plate being coupled substantially at the first base vertex of each of the at least two triangular structures, and the at least one second base interface plate being coupled substantially at the second base vertex of each of the at least two triangular structures.

The construction component of the invention further includes a cast concrete block substantially encapsulating the internal support structure therein, the at least one elevated interface plate of the internal support structure being exposed through a top surface of the concrete block, the at least one first and at least one second base interface plates being exposed through a bottom surface of the concrete block. The at least one elevated interface plate of said construction component is configured to be mechanically coupled to one of the at least one first and second base interface plates of each of at least two others of said construction component to securely couple said construction components together in a staggered manner.

In a further embodiment, the first and second of the at least two triangular structures are disposed in planes that are substantially in parallel with one another.

In other embodiments, wherein the first and second of the at least two triangular structures are isosceles triangles.

In still further embodiments, the at least one cross-coupled member is coupled substantially between the vertex of each of the first and second of the at least two triangular structures.

In other embodiments, the cross-coupled member is coupled substantially between the vertex of the first of the at least two triangular structures and at least one of the two base vertices of the second of the at least two triangular structures.

In another embodiment, the at least one cross-coupled member is coupled substantially between at least one of the base vertices of the first of the at least two triangular structures, and at least one of the two base vertices of the second of the at least two triangular structures.

In other aspects of the construction component of the invention, the concrete block includes a thermally resistant layer that substantially divides the concrete block into at least two substantially discrete concrete sections, and the first and second of the at least two triangular structures are each encapsulated within a different one of the concrete sections.

In other embodiments, the at least one cross-coupled member is coupled substantially between the first congruent members of each of the first and second of the at least two triangular structures to provide cross-coupling between the upper vertices and the first base vertices of the first and second triangular structures.

In still further embodiments, the at least one cross-coupled further provides cross-coupling between each of the upper vertices one of the first and second triangular structures, and the each of the first base vertices of the other respectively.

In a further embodiment, the at least one cross-coupled member spans the thermally resistant layer of the block between the first and second of the at least two triangular structures.

In other embodiments, the base member and two congruent side members of the first and second of the at least two triangular structures are made of thermally conductive metal, and the cross-coupled member is made of a thermally resistant material.

In other aspects of the invention, a wall structure has an embedded internal structural reinforcement lattice that is configured to be directly coupled to a foundation. The wall structure includes a plurality of pre-fabricated structural components, each of the pre-fabricated structural components including an internal support structure, the support structure including at least one non-rectangular structure. The at least one non-rectangular structure is formed of at least one base member and a plurality of side members to form a first base vertex between a first one of the side members and the base member, a second base vertex between a second one of the side members and the at least one base member. Internal structure further includes at least one elevated interface plate that is structurally coupled to at least one of the side members and first and a second base interface plates, the first base interface plate coupled to the at least one non-rectangular structure substantially at the first base vertex, and the second base interface plate coupled to the at least one non-rectangular structure substantially at the second base vertex. The plurality of components includes a cast concrete block that substantially encapsulates the internal support structure. The at least one elevated interface plate of the internal support structure is exposed through a top surface of the concrete block, and the first and second base interface plates are exposed through a bottom surface of the concrete block. The elevated interface plate of the construction component is configured to be mechanically coupled to one of the base interface plates of each of at least two others of the plurality of pre-fabricated construction components to securely couple said plurality of construction components together to form the wall structure and to establish the integrated reinforcement lattice therein.

The prefabricated components can be of a standard component, as well as non-standard and specialty components. all of which have the commonality of the basic internal support structure embedded therein, and all capable of being coupled to each other to create a fully integrated support lattice within the constructed wall structure. Moreover, such walls may then be coupled together to fully integrate the structurally reinforcing internal structure lattice throughout an entire structure made from multiple wall structures of the invention.

BRIEF DESCRIPTION OF THE DRAWINGS

The following description can be better understood in light of Figures, in which.

DETAILED DESCRIPTION

Various embodiments of a construction component are disclosed that are internally reinforced with triangular reinforcing structures during their fabrication, and are capable of being bolted together in lieu of employing conventional techniques such as creating mortar joints. Because the construction component of the invention can be pre-fabricated with the internal triangular reinforcement structure incorporated, no additional reinforcement need be undertaken on site during construction of walls made therewith. The triangular internal reinforcement structure includes interface plates, located at the vertices of the triangular structure, by which to mechanically couple the triangular reinforcement structures to the internal triangular reinforcement structures of adjacent and overlapping building components in the form of a lattice. It is this ability to mechanically interconnect the internal triangular reinforcement structures of all of the building components within a structure constructed therewith, which eliminates the labor intensive procedures as discussed above that are required when using conventional constructional components.

Figure 1:
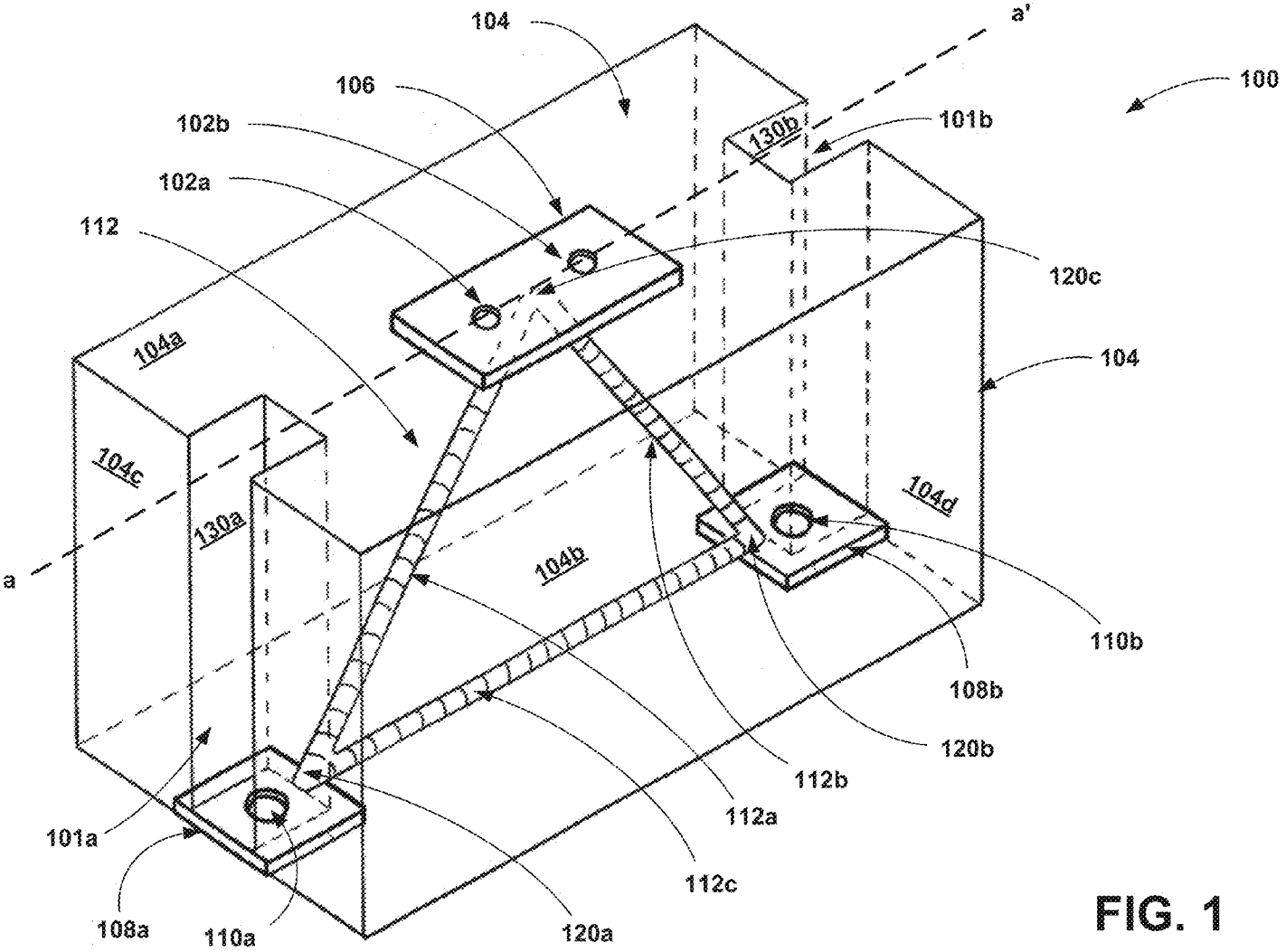
FIG. 1 illustrates perspective view of an embodiment of the construction component of the invention with a load bearing triangular reinforcement structure disposed therein.

FIG. 1 illustrates a perspective view of an embodiment 100 of a construction component of the invention, having an internal load bearing triangular reinforcement structure 112 disposed therein. The construction component 100 can be constructed of, for example, cast concrete and can be cast to assume the form of a building block 104. Block 104 can be made with dimensions such as those of a conventional CMU, or any other dimensions and geometric forms suitable for a particular construction application. The internal load bearing triangular structure 112 can be formed of any suitable material that is capable of providing the required structural support and coefficient of thermal expansion consistent with the material forming the cast block. As previously discussed above, ribbed steel rebar and concrete have very similar thermal expansion properties and are therefore a good combination. The embedded internal support structure 112 and can be cast within the block 104 by aligning it within a cast mold of the block before pouring the concrete into the mold. Embedded internal support structure 112 can be held in place during the casting process by, for example, by bolting it to the bottom of the cast mold.

The three members 112*a*, 112*b* and 112*c* of the internal support structure 112 can be dimensioned to form an isosceles triangle. The internal support structure 112 can be constructed of a single integral piece of metal, or may be constructed of separate members that are structurally fused using an appropriate technique such as welding. The structure further includes three interface plates 106, 108*a* and 108*b*, to which the members 112*a*, 112*b* and 112*c* are coupled at or near their vertices. The interface plates 106, 108*a* and 108*b* can be formed integrally with members 112*a*, 112*b* and 112*c*, or they can be structurally joined such as by a welding process.

In an embodiment, the base member 112*c* of the isosceles triangle forming internal support structure 112 is disposed substantially proximate to, and parallel with, the base surface 104*b* of concrete block 104. Base interface plates 108*a* and 108*b* are disposed in parallel with and substantially on top of the base surface 104*b*. The bottom surface of base interface plates 108*a* and 108*b* can be exposed through the base surface 104*b* of concrete block 104. In an embodiment, the base vertices 120*a* and 120*b* of internal support structure 112 are each coupled to the top surface of the two base plates 108*a* and 108*b* respectively.

In an embodiment, each of base interface plates 108*a* and 108*b* have openings 110*a* and 110*b* respectively disposed through them, each for receiving a threaded coupling bolt (not shown) in FIG. 1. Openings 110*a* and 110*b* can be made accessible from the top via vertical channels 101*a* and one 101*b* respectively, which can be cast into end surfaces 104*c* and 104*d* of concrete block 104 respectively. The width and depth of vertical channels 101*a* and 101*b* can be dimensioned to be smaller than base interface plates 108*a* and 108*b* to ensure that sufficient cast concrete overlaps the base interface plates, thereby fixedly holding them and the triangular support structure 112 within the cast concrete. The openings 110*a* and 110*b* are also preferably exposed through base surface 104*b*.

Internal support structure 112 is oriented with block 104 such that top vertex 120*c*, formed by the two congruent sides 112*a* and 112*b* of isosceles of the triangular support structure 112, is located at or substantially near the top surface 104*a* of concrete block 104, and is coupled to upper interface plate 106. The top surface of upper interface plate 106 lies in a plane that is parallel with the top surface 104*a* of block 104, and can be exposed through the top surface 104*a*. Upper interface plate 106 can be about twice the length of the base interface plates 108*a* and 108*b*, and has two threaded openings 102*a* and 102*b* disposed through it. The openings 102*a* and 102*b* are exposed and accessible to receive threaded bolts (not shown) through top surface 104*a*.

Figure 2:
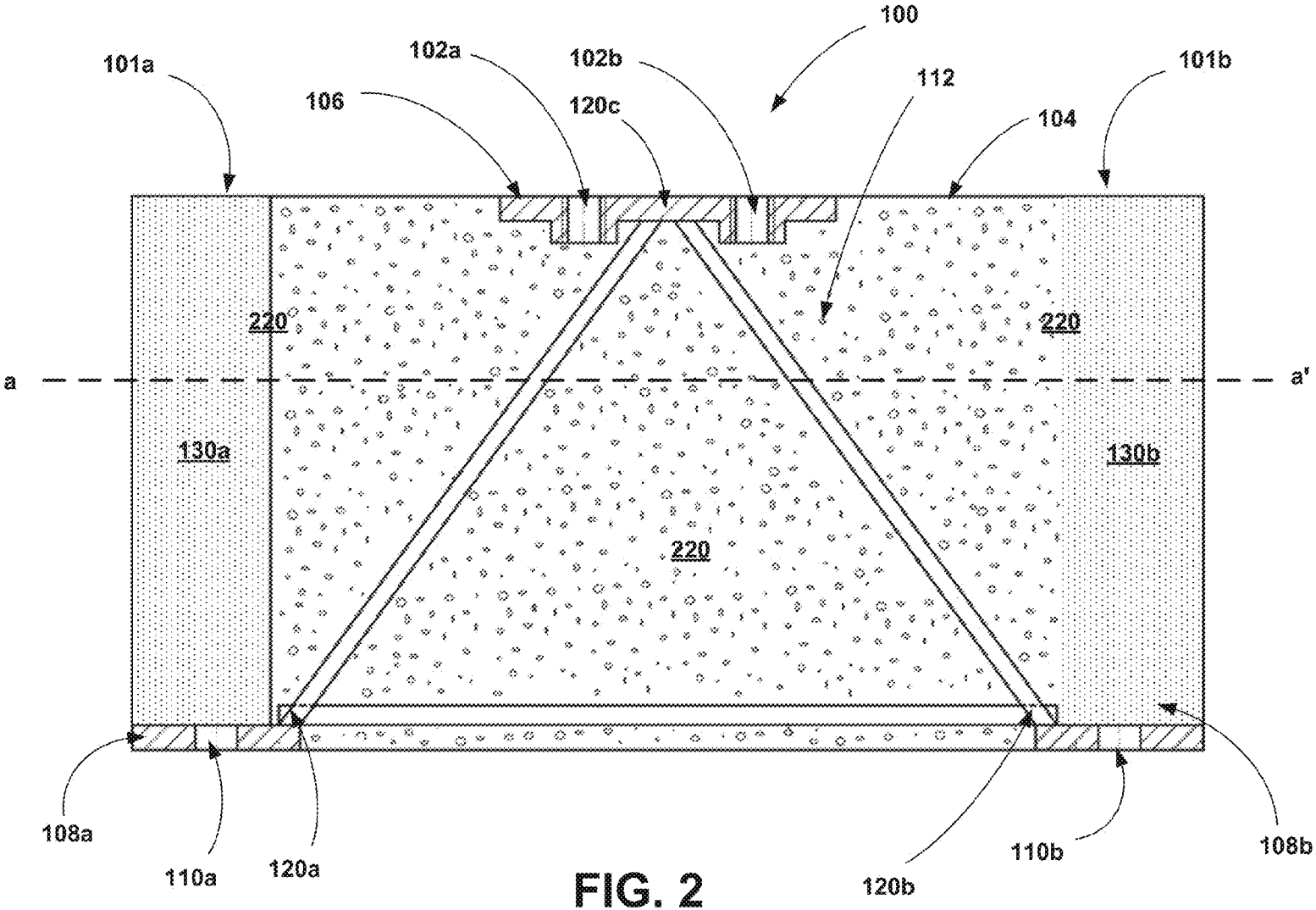
FIG. 2 illustrates a cross-sectional view of the embodiment of the construction component of the invention as shown in FIG. 1.

FIG. 2 illustrates a cross-sectional view of the embodiment 100 of the construction component of the invention as illustrated in FIG. 1, taken along line a-a'. As can be seen from FIG. 2, upper interface plate 106 can be structurally fused to the vertex 120*c* of triangular shaped internal support structure 112 and is exposed through the top surface 104*a* of block 104. Single base interface plates 108*a* and 108*b* are structurally fused to triangular structure 112 at base vertices 120*a* and 120*b* respectively, each being disposed at the bottom of block 104 and exposed through bottom surface

104*b*. Threaded holes 102*a* and 102*b* are formed in upper interface plate 106, having a suitable diameter and a length suitable for ensuring sufficient coupling strength between plate 106 and threaded bolts (not shown), used to couple block 104 to the single base interface plates 108*a* and 108*b* of other like components, placed in a staggered relationship therewith (See FIG. 3).

As can be seen, triangular shaped internal support structure 112 can be, except for the bottom surfaces of its interface plates, completely encapsulated and fixed within block 104 by cast concrete 220. Internal surface 130*a* and 130*b* of vertical channels 101*a* and 101*b* respectively are illustrated with a different shading to indicate that they are not in the same plane as cross-sectional axis a-a'. The vertical channels 101*a* and 101*b* overlap the single interface plates on three sides to hold the single interface plates in place, but are open at each end of block 104 to permit access to the openings 110*a* and 110*b* for purposes of coupling the components 100 together from above.

Figure 3:
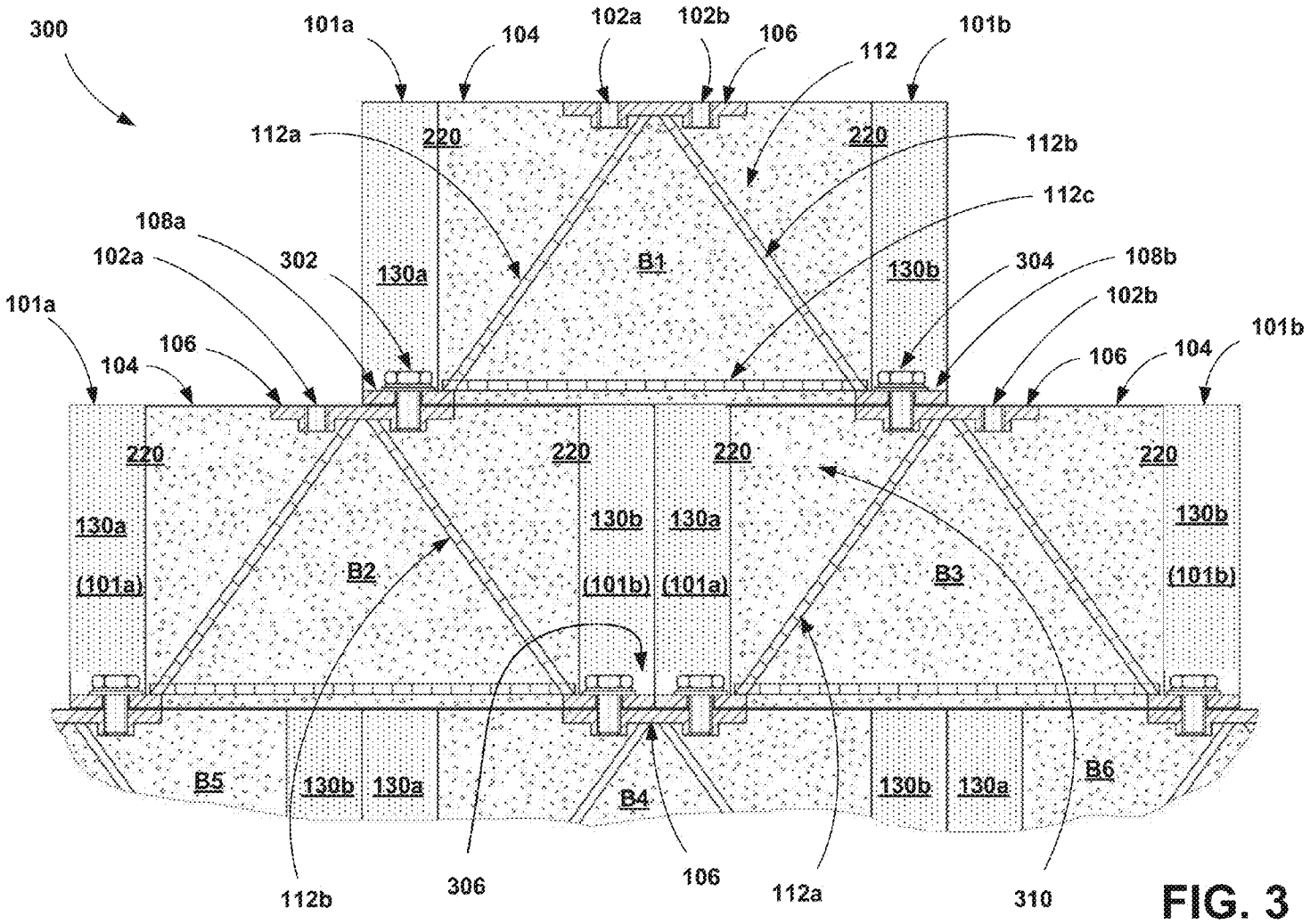
FIG. 3 illustrates a cross-sectional view of a portion of a wall constructed using the embodiment of the construction component of the invention as illustrated in FIG. 1 and FIG. 2 to create a support lattice between the components.

FIG. 3 illustrates a portion of a wall 300 that has been constructed using the building components 100 of the invention. The view of wall 300 is of the same cross-sectional view as that of the building component 100 as illustrated in FIG. 2. As will be evident to those of skill in the art, each row of the building components 100 are staggered just as when employing conventional CMUs built with mortar joints. The right-most side (as viewed) of the upper interface plate 106 of building component B2 can be coupled to the single base plate 108*a* of building component B1, by using access provided through vertical channel 101*a* of component B1 to insert threaded bolt 302 through opening 110*a* of single base plate 108*a* of component B1, and screwing it into threaded opening 102*b* of upper interface plate 106 of component B2.

Likewise, the left-most side (as viewed) of the upper interface plate 106 of component B3 can be coupled to the single base plate 108*b* of component B1, by using access provided through vertical channel 101*b* of component B1 to insert threaded bolt 304 through opening 110*b* of single base plate 108*b* of block B1, and screwing it into threaded opening 102*a* of upper interface plate 106 of component B3.

Upper interface plate 106 of building component B4 (only partially shown) is similarly coupled to the single base interface plates 108*b* of building component B2 and single base interface plate 108*a* of building component B3. Vertical channels 101*b* and 101*a* of components B2 and B3 are ultimately covered by component B1. Those of skill in the art will appreciate that all of the internal triangularly shaped support structures 112 are interconnected much like a crystalline lattice. The interconnected internal support structures 112 also form shared inverted isosceles triangular support structures, such as inverted triangle 310, which shares a vertex 306 with component B4, and is formed by triangle member 112*b* of the embedded internal support structure 112 of component B2, member 112*a* of the internal support structure 112 of component B3, and base member 112*c* of the internal support structure 112 of component B1.

Based on the foregoing, those of skill in the art will appreciate that in addition to the benefit of eliminating onsite performance of labor intensive steps such as joining the components with mortar joints and performing conventional on site structural reinforcement as described above, the construction component of the invention produces structural reinforcement that is superior to that of conventional steel rebar reinforcement and grout that simply runs vertically through the aligned channels of conventional concrete blocks such as CMUs. The construction component of the invention 100 provides a ratio of structural strength to the amount of reinforcement material (e.g. steel rebar) used is significantly greater than that of conventional reinforcement techniques.

It will further be appreciated that while the embodiments illustrated in FIG. 1 through FIG. 3 employ threaded bolts by which to couple the interface plates of the adjoining components of the invention, other suitable means for coupling the components may be employed without exceeding the intended scope of the invention. For example, riveting techniques could be employed, or self-locking fasteners. It will be appreciated that employing bolts permits a structure to be easily disassembled, so that the components can be re-used. Conventional construction requires that a structure such as a wall be destroyed through such techniques such as wrecking balls or dynamite. These techniques typically damage or destroy the majority of the building components, preventing them from being fully redeployed.

Figure 4:
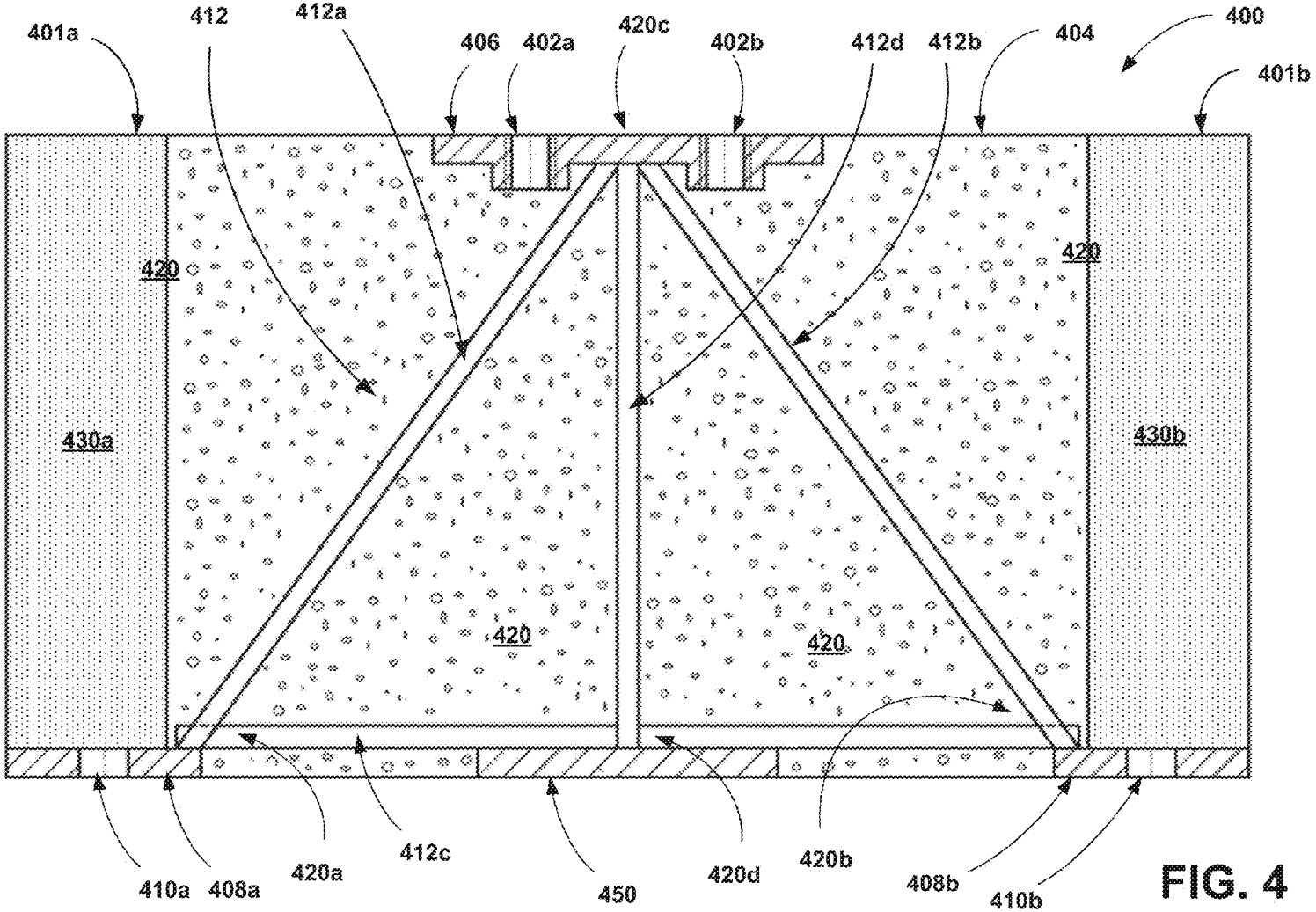
FIG. 4 illustrates a cross-sectional view an embodiment of the construction component of the invention having an additional vertical support member and middle plate.

FIG. 4 illustrates a cross-sectional view of an embodiment 400 of the construction component of the invention similar to that of FIG. 2, except that the isosceles triangular shaped internal support structure 112 includes a fourth vertical member 412*d*, in addition to triangle base member 412*c* and congruent members 412*a* and 412*b*. Vertical member 412*d* can substantially bisect the isosceles triangle formed by members 412*a*, 412*b* and 412*c*, structurally fused with congruent members 412*a* and 412*b* at vertex 420*c*. Vertical member 412*d* can extend to and be structurally fused with the base member 412*c*, at a point approximately half way between vertices 420*a* and 420*b*. Vertical member 412*d* can also be structurally fused with a support plate 450, which is disposed at, and can be exposed through, the bottom surface 404*b* of block 404.

Like the embodiments of FIG. 1 through FIG. 3, embodiment 400 is preferably made of cast concrete 420 that encases internal support structure 412. Support structure 412 has an upper interface plate 406 structurally fused with congruent members 412*a* and 412*b* at vertex 420*c*. Upper interface plate 406 has threaded openings 402*a* and 402*b* therein for receiving threaded bolts (not shown). Single interface base plate 408*a* is structurally fused with members 412*a* and 412*c* at base vertex 420*a* and single interface base plate 408*b* is structurally fused with members 412*b* and 412*c* at base vertex 420*b*. Base interface plates 408*a* and 408*b* include openings 410*a* and 410*b* respectively, therethrough. Embodiment would be assembled into a wall in the same manner as that illustrated in FIG. 3, including accessing the interface plates for inserting and screwing in bolts (not shown) through vertical channels 401*a* and 401*b*. It will be appreciated by those of skill in the art that the additional vertical member 412*d* and support plate 450 provide additional structural support against compression.

Figure 5A:
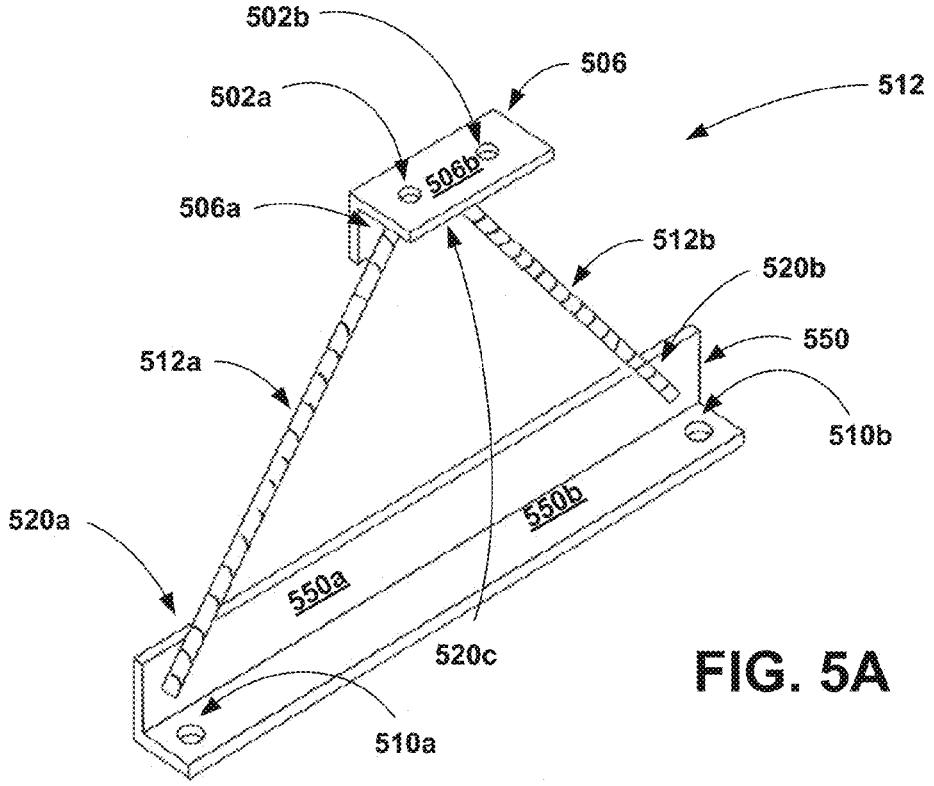
FIG. 5A illustrates a perspective view of an embodiment of the construction component of the invention having an L-shaped bar forming its base.

FIG. 5A illustrates a perspective view of an embodiment 512 of the internal support structure of the construction component of the invention, that employs a commercially available L-shaped bar 550 to serve the purpose of both the base member of the isosceles triangle of the support structure 512, as well as the base interface plates of earlier presented embodiments. Congruent members 512*a* and 512*b* are structurally fused at base vertices 520*a* and 520*b* respectively, to the inside of face of vertical segment 550*a* of the L-shaped bar. Openings 510*a* and 510*b* are disposed through the horizontal face 550*b* of the L-shaped bar 550.

The opposite ends of congruent members 512*a* and 512*b* can be structurally fused to upper interface plate 506 individually, or first to one another, and then to interface plate 506 (not shown), to establish vertex 520*c*. They can be structurally fused to the inside face of vertical segment 506*a*, to the bottom face of horizontal segment 506*b*, or both. Upper interface plate 506 includes two threaded openings 502*a* and 502*b* by which to receive and secure threaded bolts in the same manner as previously illustrated. In the embodiment of FIG. 5A, the upper interface plate can also be L-shaped, with the threaded openings disposed in the horizontal segment 506*b* and the congruent members structurally fused to the horizontal face 550*a*.

Those of skill in the art will appreciate that construction components of the invention can be constructed with support structure 512 in the same manner as embodiments previously disclosed, by disposing the support structure 512 within a casting mold and pouring concrete therein to create a cast concrete block with support structure 512 nearly completely encapsulated by concrete. The top surface (along with threaded openings 502*a* and 502*b*) of horizontal segment 506*b* of upper interface plate 506 will be exposed at the top surface of the cast concrete block, and the bottom surface of horizontal segment 550*b* of L-shaped bar 550 will be exposed at the bottom of the concrete block. Openings 510*a* and 510*b* are also made accessible from the top by forming vertical channels as part of the casting process (as described above for previously disclosed embodiments), to permit the insertion of threaded bolts through the openings 510*a* and 510*b*, and into threaded openings 502*a* and/or 502*b* of the upper interface plates 506 of like staggered components as illustrated by previously disclosed embodiments.

As previously discussed, the L-shaped bar 550 and the upper interface plate 506 can be any suitable material that provides the desired structural support, but is preferably a metal such as steel. Likewise, congruent members 512*a* and 512*b* are preferably metal rebar of a diameter that meets the desired strength of support. Also as previously discussed, techniques for fastening the interface plates of the staggered blocks other than threaded bolts may be used when constructing structures using the building components of the invention, provided those techniques ensure the requisite coupling strength.

Figure 5B:
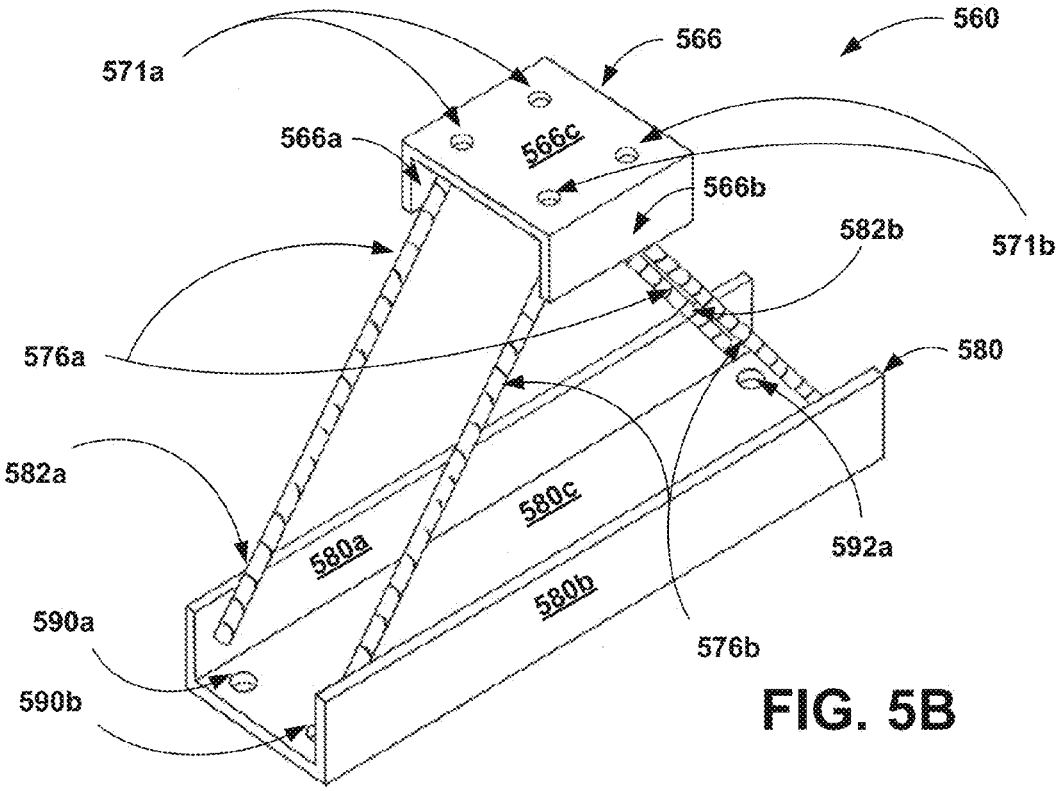
FIG. 5B illustrates a perspective view of an embodiment of the construction component of the invention having a double triangular internal support structure having a single U-shaped bar as its base.

FIG. 5B is a perspective view that illustrates an embodiment 560 of the internal support structure of a construction component of the invention that employs a commercially available U-shaped bar 580 as a common base member and base interface plate for two isosceles triangles. Congruent members 576*a* of the first triangle are structurally fused to the inside face of vertical segment 580*a* of U shaped bar 580 at base vertices 582*a* and 582*b*. The opposite ends of congruent members 576*a* are structurally fused to the inside face of vertical segment 566*a* of inverted U shaped interface plate 566, to the lower surface (not shown) of horizontal face 566*c* or both.

The congruent members 576*b* forming the second isosceles triangle are structurally fused to the inside surface (not shown) of vertical segment 580*b* of U shaped bar 580. Likewise, the opposite ends of congruent members 576*b* are structurally fused to the inside face of vertical segment 566*b* of inverted U shaped interface plate 566. U shaped bar 580 can have two openings 590*a*, 590*b* and 592*a*, 592*b* (obscured in FIG. 5B) at each end. Likewise, inverted U shaped interface plate 566 has two corresponding pairs of threaded openings 571*a* and 571*b*, for receiving threaded bolts used for coupling staggered components.

Those of skill in the art will appreciate that construction components of the invention can be constructed with support structure 560 in the same manner as embodiments previously disclosed, by disposing the support structure 560 within a casting mold and pouring concrete therein to create a cast concrete block such that support structure 560 is nearly completely encapsulated by concrete. The top surface of the horizontal segment 566*c* (as well as threaded openings 571*a* and 571*b*) of inverted U shaped interface plate 566, will be exposed at the top surface of the cast concrete block. Likewise, the bottom surface of the horizontal segment 580*c* of U-shaped bar 580 will be exposed at the bottom of the concrete block. Openings 590*a, b* and 592*a, b* are also made accessible from the top by forming vertical channels as part of the casting process (as described above for previously disclosed embodiments), to permit the insertion of threaded bolts through the openings 590*a, b* and 592*a, b* and into threaded openings 571*a* and/or 571*b* of the upper interface plates 566 of like staggered components as illustrated for previously disclosed embodiments. One vertical channel can be cast for each pair of the openings, or two vertical channels can be cast for each one of the pair.

It will be appreciated by those of skill in the art that by doubling the number of triangular support structures, as well as widening the interface plates and increasing the number of coupling points between the interface plates, even greater reinforced structural support and stability can be achieved within a building component, as well as throughout a structure built with such components.

Figure 6A:
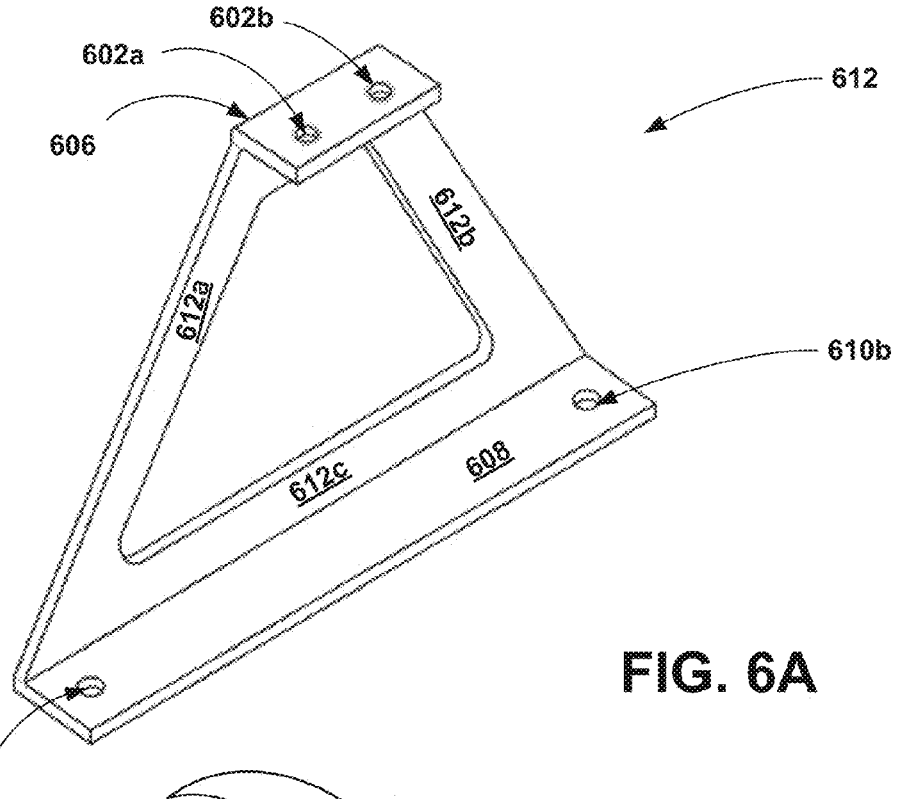
FIGS. 6A and 6B illustrate a perspective view of the embodiments of the construction component of the invention generally shown in FIGS. 5A and 5B respectively, but each made of a single unitary piece of metal.

FIG. 6A illustrates a perspective view of an embodiment 612 of the internal support structure of the construction component of the invention. Internal support structure 612 is similar to the embodiment 512 of FIG. 5A, but is constructed such that the isosceles triangle and its interface plates are of a unitary piece, such as pressed metal, and bending the metal to form the horizontal segments of the interface plates 606 and 608. Segments 612*a*, 612*b* and 612*c* form the members of the isosceles triangle shape, while bent segments 606 and 608 form the upper interface plate and the base interface plates respectively. Threaded openings 602*a* and 602*b* are configured to receive threaded bolts in the same manner as previously disclosed embodiments, and openings 610*a* and 610*b* are configured to receive threaded bolts as previously disclosed by which to secure staggered components together as previously disclosed.

Those of skill in the art will appreciate that construction components of the invention can be constructed with support structure 612 in the same manner as embodiments previously disclosed, by disposing the support structure 612 within a casting mold and pouring concrete therein to create a cast concrete block such that support structure 612 is nearly completely encapsulated by concrete. The top surface of the bent interface plate 606, will be exposed at the top surface of the cast concrete block. Likewise, the bottom surface of the bent base interface plate will be exposed at the bottom of the concrete block. Openings 610*a* and 610*b* are also made accessible from the top of the construction component by forming vertical channels as part of the casting process (as described above for previously disclosed embodiments), to permit the insertion of threaded bolts through the openings 610*a* and 610*b* and into threaded openings 602*a* and 602*b* of the upper interface plate 606 of like staggered components as illustrated by previously disclosed embodiments.

Figure 6B:
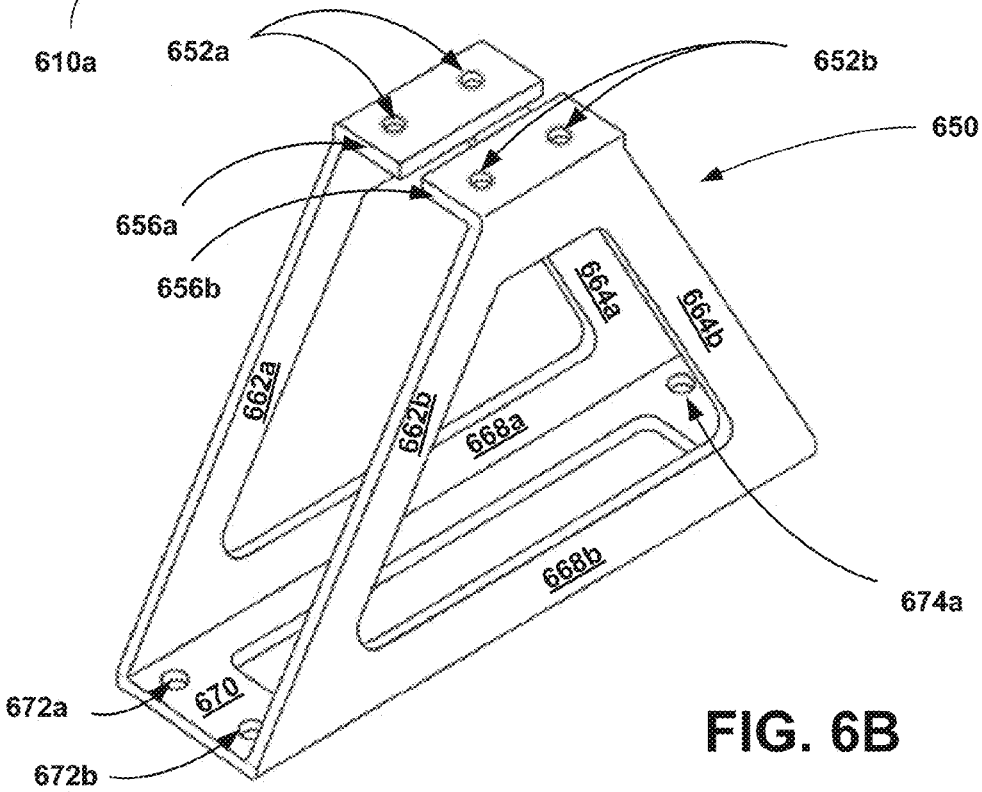

FIG. 6B illustrates a perspective view of an embodiment 650 of the internal support structure of the construction component of the invention that is similar to the embodiment 560 of FIG. 5B. Again, with respect to embodiment 612 of FIG. 6A, the primary difference is that the embodiment 650 of FIG. 6A is made from a single unitary piece. As is the case for embodiment 612*a*, embodiment 650 can be made from pressed sheet metal, and then bent to form base interface plate 670, as well as the two upper interface plates 656*a* and 656*b*, to form a triangular shape having a common base interface plate. Segments 662*a*, 664*a* and 668*a* form one of the triangles, and segments 662*b*, 664*b* and 668*b* form the second. Pairs of threaded openings 652*a* and 652*b* are formed in bent interface plate segments 656*a* and 656*b* respectively and configured to receive threaded bolts as in previously disclosed embodiments. Corresponding pairs of openings 672*a*, 674*a* and 672*b*, 674*b* (not shown) are formed in base interface plate segment 670 and are configured to receive threaded bolts as they are inserted into threaded openings 652*a* and 652*b* of staggered components as illustrated by previously disclosed embodiments.

Those of skill in the art will appreciate that construction components of the invention can be constructed with support structure 650 in the same manner as embodiments previously disclosed, by disposing the support structure 650 within a casting mold and pouring concrete therein to create a cast concrete block such that support structure 650 is nearly completely encapsulated by concrete. The top surface of each of the bent interface plate segments 656*a* and 656*b* (as well as threaded openings 652*a* and 652*b*) will be exposed at the top surface of the cast concrete block. Likewise, the bottom surface of the horizontal base interface plate segment 670 will be exposed at the bottom of the concrete block. Openings 672*a, b* and 674*a,b* are also made accessible from the top by forming vertical channels as part of the casting process (as described above for previously disclosed embodiments), to permit the insertion of threaded bolts through the openings 672*a, b* and 674*a, b* and into threaded openings 652*a* and/or 652*b* of the bent interface plate segments 656*a* and 656*b* of like staggered components as illustrated for previously disclosed embodiments. One vertical channel can be cast for each pair of the openings in the base interface segment 670, or two vertical channels can be cast for each one of the pair.

Figure 7:
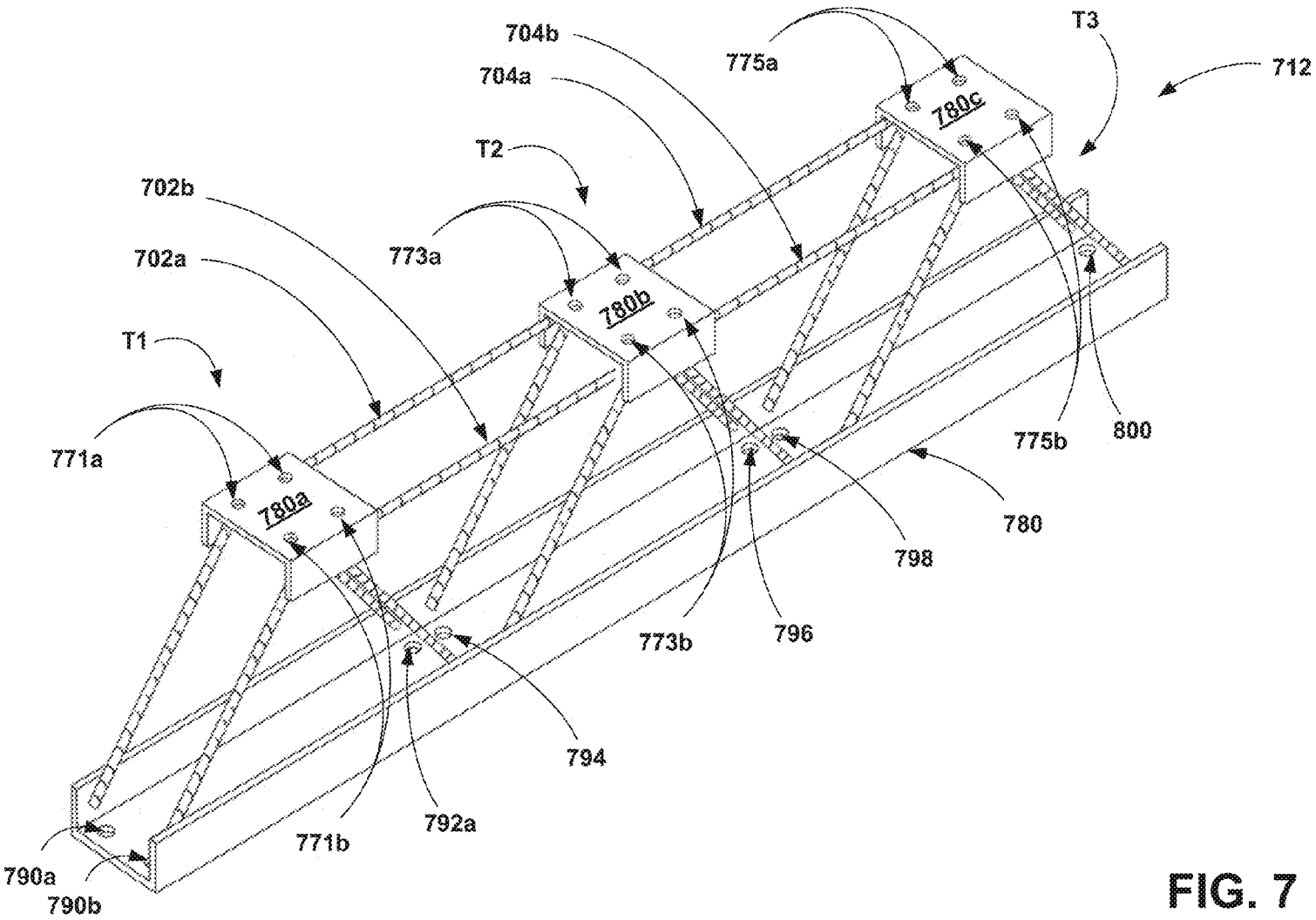
FIG. 7 illustrates a perspective view of an embodiment of the construction component of the invention employing a series of double triangular internal supports such as the embodiment of FIG. 5B, adapted to accommodate larger dimensions.

FIG. 7 illustrates a perspective view of an embodiment 712 of the internal support structure of the invention adapted to place multiple instantiations of the embodiment 560 of FIG. 5B in series for building components of larger dimensions. As illustrated, the embodiment 560 of FIG. 5B has been repeated three times and the three individual instantiations are denoted T1, T2 and T3. In addition, triangles T1 and T2 are cross-coupled together by members 702*a* and 702*b* that are structurally fused between inverted U shaped interface plates 780*a* and 780*b* of triangular support structures T1 and T2 respectively. Triangles T2 and T3 are cross-coupled by members 704*a* and 704*b*, which are structurally fused to inverted U shaped interface plates 780*b* and 780*c* of triangular support structures T2 and T3 respectively. Each of the inverted U shaped interface plates 780*a*, 780*b* and 780*c* of instantiations T1, T2 and T3 have two sets of threaded openings 771*a, b*; 773*a, b*; and 775*a, b* as disclosed in FIG. 5B.

In embodiment 712, U-shaped base interface plate 780 is shared by all three instantiations of the triangular support structures T1, T2 and T3, but each instantiation has its own two sets of openings 790*a,b* and 792*a,b*; 794*a,b* and 796*a,b*; 798*a,b* and 800*a,b*. (Some of the openings are obscured by the view). Those of skill in the art will appreciate that providing a plurality of instantiations will permit constructions components of the invention that are, for example, multiples in length of a standard size. These can be useful whenever larger construction components may be preferable, such as when building eaves and overhangs.

Those of skill in the art will appreciate that construction components of the invention can be constructed with support structure 712 in the same manner as embodiments previously disclosed, by disposing the support structure 712 within a casting mold and pouring concrete therein to create a cast concrete block such that support structure 712 is nearly completely encapsulated by concrete. The top surface of each of the inverted U shaped interface plates 780*a*, 780*b* and 780*c* will be exposed at the top surface of the elongate cast concrete block, along with their respective sets of threaded openings 771*a, b* 773*a, b* and 775*a, b*. Likewise, the bottom surface of the U-shaped base interface plate 780 will be exposed at the bottom of the concrete block, along with openings 790*a, b* and 792*a, b*; 794*a, b* and 796*a, b*; 798*a, b* and 800*a, b*. The openings of base plate 780 are also made accessible from the top by forming vertical channels over each pair, over some combinations of pairs, or each individual opening (whichever is preferable) as part of the casting process. As described above for previously disclosed embodiments, the vertical channels can permit the insertion of threaded bolts through the openings 590*a, b* and 592*a, b* and into threaded openings of the inverted U-shaped interface plates 780*a, b*, and *c* of like sized building components, or smaller components of the invention in a staggered fashion as previously illustrated for other disclosed embodiments.

Figure 8:
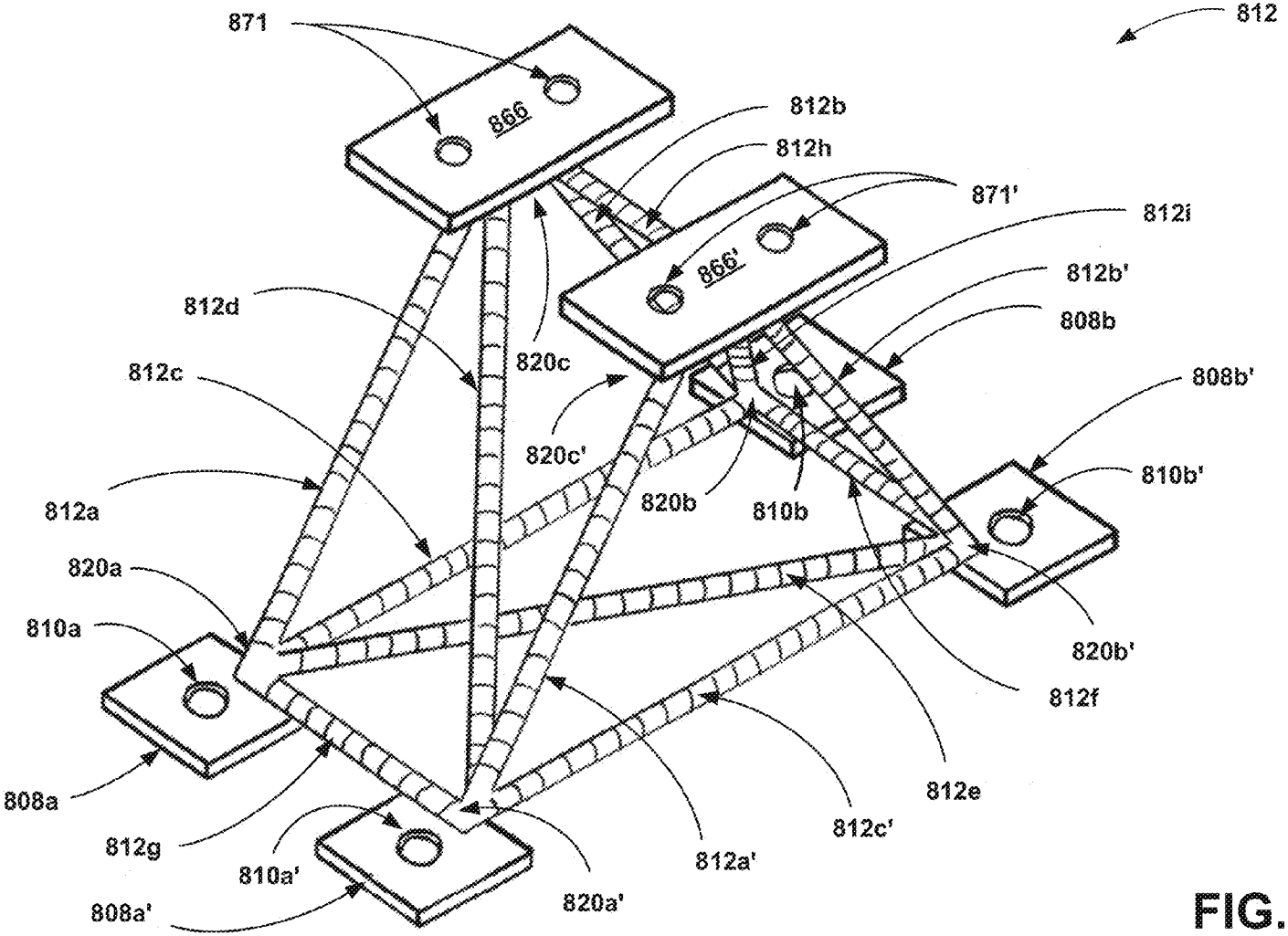
FIG. 8 illustrates a perspective view of an embodiment of the construction component of the invention having two cross-coupled triangular internal support structures.

FIG. 8 illustrates an embodiment 812 of an internal support structure of a building component of the invention that provides highly enhanced structural reinforcement of such a building component. Internal support structure 812 includes two isosceles triangles. One of the triangles is formed of members 812*a*, 812*b* and 812*c*, and the other is formed of members 812*a*', 812*b*' and 812*c*'. The congruent members 812*a*, 812*b* and 812*a*', 812*b*' of each of the triangles is structurally fused with an upper interface plate 866 and 866' at its vertex opposite its base member. Upper interface plates 866 and 866' each include a pair of threaded openings 871 and 871' configured to receive threaded bolts as in previously disclosed embodiments. Each triangle is structurally fused to a pair of base interface plates 808*a, b* and 808*a*', b' at its base vertices 820*a*, 820*b* and 820*a*', 820*b*' respectively, each of which are opposite of its congruent members 812*a, b* and 812*a*', b' respectively. Each of the interface plates 808*a, b* and 808*a*', b' include a single opening 810*a, b* and 810*a*', b' respectively.

Additionally, embodiment 812 of the internal support structure of a building component of the invention includes additional reinforcing members that cross couple the two triangles to provide further structural reinforcement of a construction component in which it is incorporated. Member 812*f* is structurally fused between one end of base members 812*c* and 812*c*' at base vertices 820*b* and 820*b*' respectively. Likewise, member 812*g* is structurally fused between the opposite ends of base members 812*c* and 812*c*', at base vertices 820*a* and 820*a*'. Member 812*e* is structurally fused with base members 812*c* and 812*c*' diagonally at base vertices at 820*a* and 820*b*'. Members 812*e-f* therefore create additional cross-coupling between the bases of each of the triangles to provide even greater structural reinforcement perpendicularly and diagonally to the orientation of the base members 812*c* and 812*c*' of the triangles.

Further cross-coupling can be created from the upper vertex 820*c*, 820*c*' of each of the triangles, such as by member 812*d*, which is structurally fused between vertex 820*c* and base vertex 820*a*'. Member 812*i* (partially obscured) is structurally fused between upper vertex 820*c*' and base vertex 820*b*. Member 812*h* (partially obscured) is structurally fused between upper vertex 866 and upper vertex 866'. In the embodiment of FIG. 8, each of the six vertices of the double triangle are coupled to through four members to four other vertices.

It will be appreciated by those of skill in the art that cross-coupling each of the two triangles between their vertex and a base vertex of the other triangle creates a system of triangles that forms a support lattice within the construction component itself. This lattice reinforces the component against stress and tensional forces to create a very rigid structure that is particularly beneficial in withstanding seismic forces. The internal lattice created by this embodiment of the internal support structure can provide maximum strength with a minimal number of members.

Those of skill in the art will appreciate that construction components of the invention can be constructed with the embodiment 812 of the support structure of the invention in the same manner as embodiments previously disclosed, by disposing the support structure 812 within a casting mold and pouring concrete therein to create a cast concrete block such that support structure 812 is nearly completely encapsulated by concrete. The top surface of each of the interface plates 866 and 866' will be exposed at the top surface of the cast concrete block, along with their respective sets of threaded openings 871 and 871' respectively. Likewise, the base interface plates 808*a, b* and 808*a*', b' will be exposed at the bottom of the concrete block, along with openings 810*a, b* and 810*a*', b' respectively. The openings of base interface plates 810*a, b* and 810*a', b*' are also made accessible from the top of the cast concrete block by forming vertical channels over each opening as part of the casting process. As described above for previously disclosed embodiments, the vertical channels can permit the insertion of threaded bolts through the openings 810*a, b* and 810*a', b*' and into threaded openings 871 and 871' of the upper interface plates 866 and 866' of staggered and like-sized building components, as previously illustrated for other disclosed embodiments.

Figure 9:
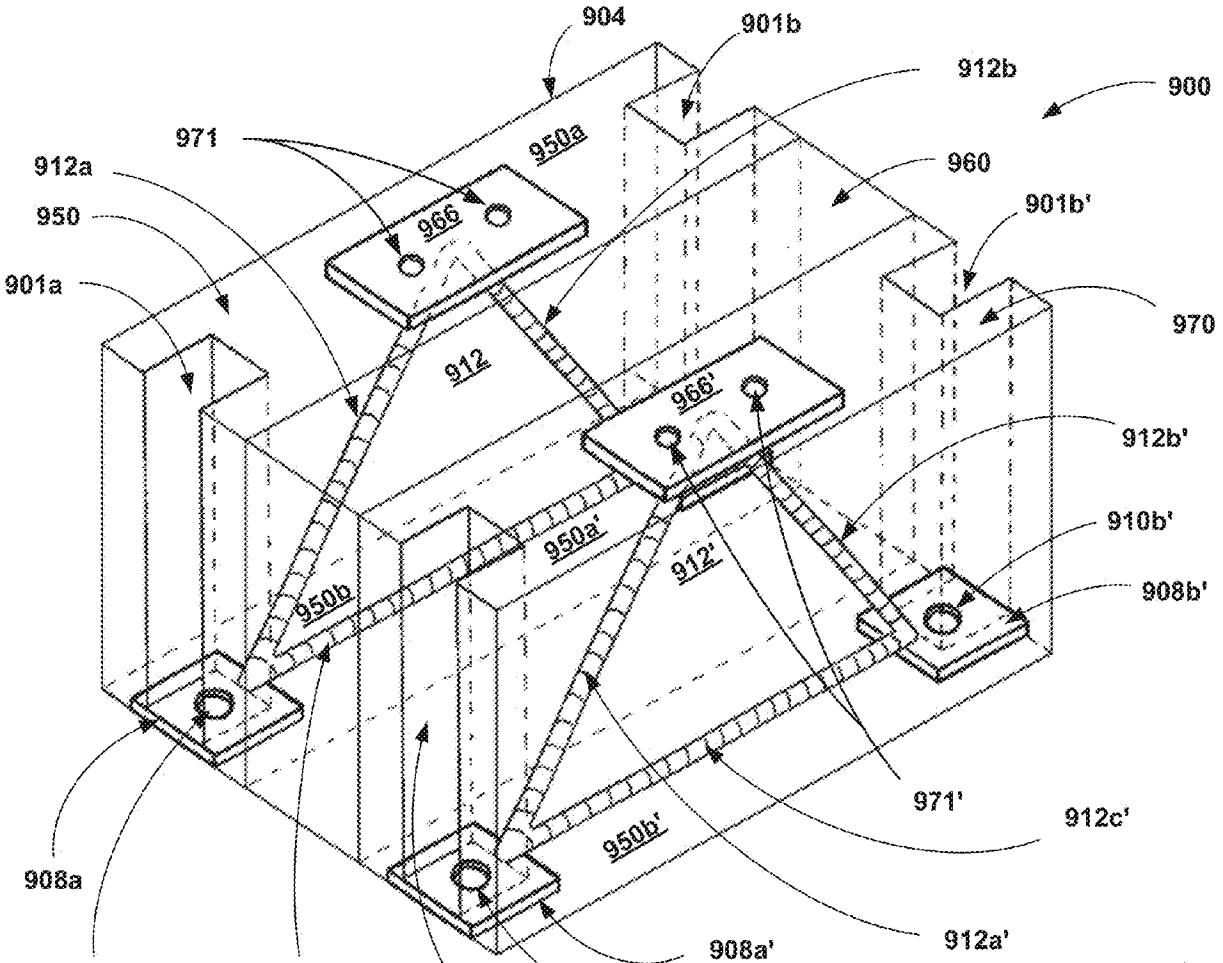
FIG. 9 illustrates a perspective view of an embodiment of the construction component of the invention having a thermal insulating layer embedded within the concrete cast block.

FIG. 9 illustrates a perspective view of an embodiment of the construction component 900 of the invention that is adapted to provide an embedded internal support structure for block that includes a thermal insulating section 960 located between two concrete sections 950 and 970. Prior art building components that employ such thermal layers tend to be bulky, as the insulation layer is commonly 3-5 inches thick. Moreover, without embedded support structures that can be mechanically coupled together during construction as previously described with respect to other embodiments disclosed herein, there is no reinforcement to keep the two concrete sections on either side together. Thus, building structures using the prior art blocks typically requires the addition of steel rebar during wall construction, which are disposed in the layer of mortar that is laid between the blocks. These thin members of rebar are typically added into the mortar running from one concrete section the other.

These members of steel rebar are typically wires with the ends bent at 90 degrees. They are typically placed about every 5 inches or so within the mortar bed, and added manually by the mason. While this technique can provide satisfactory structural reinforcement, there numerous disadvantages to such known practices, including the fact that requiring skilled masons to manually add the reinforcement members makes the process highly labor intensive and therefore expensive. Moreover, the added members of rebar provide strong thermal connectivity between the inside and outside concrete sections, thereby defeating the benefits of the thermal layer by creating short-circuits of high thermal connectivity therebetween.

In the embodiment of FIG. 9, each of the concrete sections are virtually identical to the embodiment 100 illustrated in FIGS. 1 and 2 described above. Each concrete section has a single triangular structure 912, 912' embedded therein, each composed of two congruent members 912*a, b* and 912*a*', b' and base members 912*c*, 912*c*' respectively. Each internal triangular support structure 912, 912' includes a pair of base interface plates 908*a, b* and 908*a', b*' that are exposed through the lower surfaces 950*b* and 950*b*' of the cast concrete sections in which they are embedded, respectively. Each internal triangular support structure 912, 912' further includes an upper interface plate 966, 966' having threaded openings 971, 971' that are exposed through the top surface 950*a*, 950*a*' of the cast concrete sections 950, 970 in which they are embedded, respectively. Finally, each pair of base interface plates 908*a, b* and 908*a', b*' has openings 910*a, b* and 910*a', b*' therethrough, which are made accessible from above through vertical channels 901*a, b* and 901*a', b*' respectively.

The size and material of the thermal insulating layer 960 can be varied to achieve different R values as desirable. Thermal insulating layer 960 can be made from, for example, extruded polystyrene foam. The concrete structures 950 and 970 can be made of, for example, concrete with expanded-clay aggregate filler, and an exterior layer of component 900 can be made of air-entrained concrete. It will also be appreciated that the internal support structures 912 and 912' are disposed in the concrete sections to ensure rigidity of the lattice created by the connected support structures when the components are used in building a structure such as a wall as described above for other embodiments.

Figure 10:
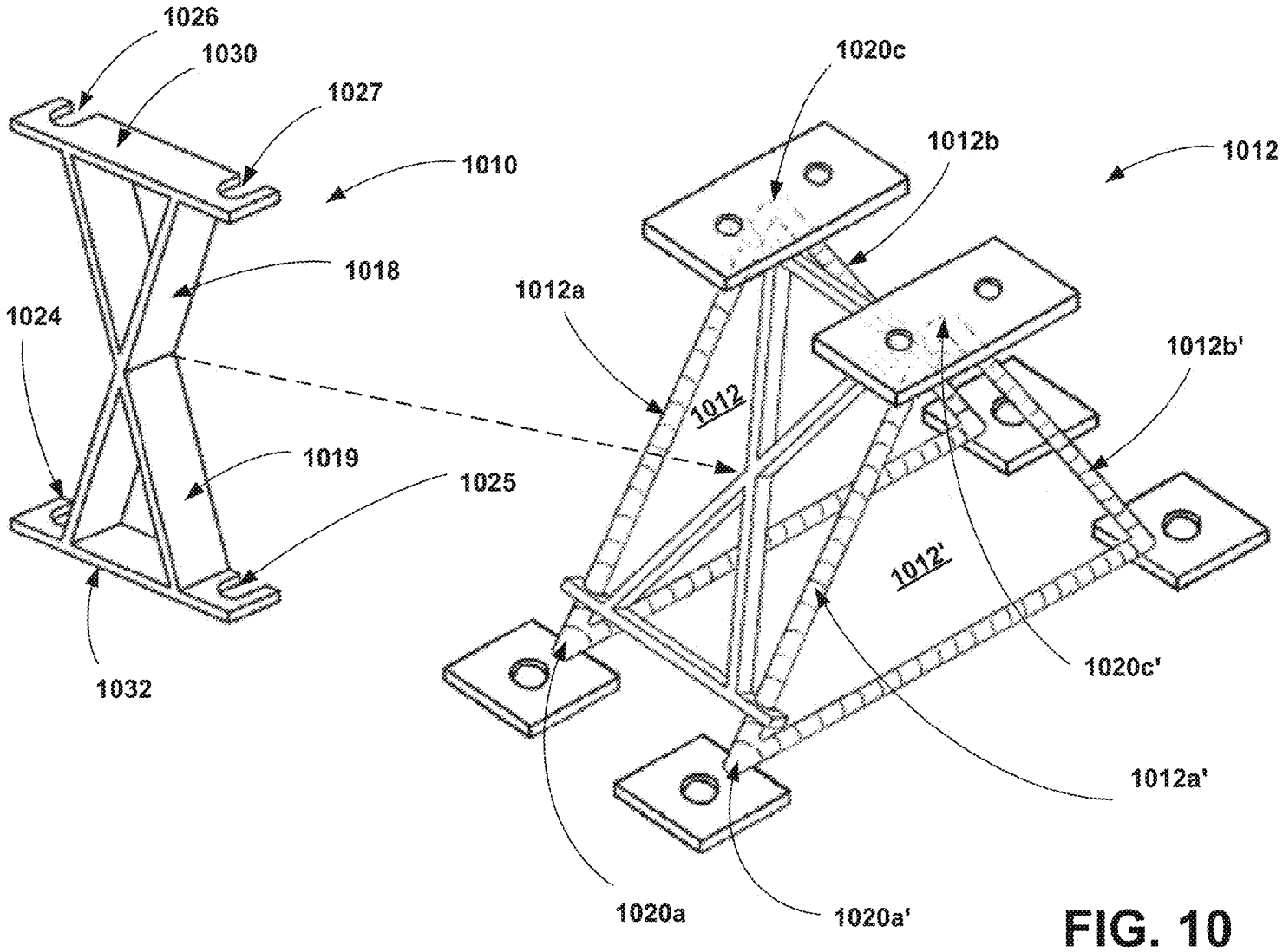
FIG. 10 illustrates a perspective view of an embodiment of the internal support structure of the construction component of FIG. 9, where the two triangular structures that are coupled through a coupling component that has low thermal conductivity.

FIG. 10 illustrates an alternate embodiment 1012 of a cross-coupled internal support structure similar to that of FIG. 9. The embodiment of FIG. 10 provides the additional advantage of cross-coupling the internal triangular structures 1012 and 1012' by attaching cross-coupling component 1010 as illustrated, which will be disposed at least partially, within the thermal section 960 of the construction component 900 of FIG. 9. Those of skill in the art will appreciate that the cross-coupling component 1010 can be composed of a unitary piece of pressed material, such as a rigid plastic, resin or fiberglass, that has suitable rigidity and strength to provide the desired mechanical cross-coupling reinforcement between the two embedded structures, yet has very low thermal conduction such that the embedded support structures can be mechanically cross-coupled while ensuring minimal thermal coupling therebetween.

Cross-coupling component 1010 has cross-coupled members 1018 and 1019 that terminate at upper coupling member 1030 and lower coupling member 1032. Upper 1030 and lower 1032 coupling members include rounded notches 1026, 1027 and 1024, 1025 respectively for receiving congruent members off the triangular support structures 1012 and 1012' as illustrated. Thus, a cross-coupling component 1010 can be coupled to the triangular structures 1012 and 1012' such that notches 1026 and 1024 receive member 1012*a* at just below vertex 1020*c* and just above vertex 1020*a* respectively of 1012, and notches 1027 and 1025 receive member 1012*a*' just below vertex 1020*c*' and just above 1020*a*' respectively. The notches can provide one way to permit the mechanical coupling between the cross-coupling component 1010 and the support structures through deformation, because they are made of disparate materials that do not permit them to be structurally fused. Likewise, another cross-coupling component can be disposed at the opposite end (not shown) of the two triangular structures 1012 and 1012' by which to cross-couple congruent members 1012*b* and 1012*b'* together.

Those of skill in the art will appreciate that further embodiments of the construction element of the invention are possible based on the foregoing disclosure. For example, as previously discussed with respect to the embodiment of FIG. 7, varying sizes of the construction elements are possible by providing multiple instantiations of the embedded internal support structures 112, 512, 560, 612, 650, 812, 912 and 1012, horizontally as shown in FIG. 7 or even vertically, in the form of single larger pre-manufactured block. These larger sized blocks can be particularly useful for minimizing the number of construction components required for wall construction, or for application over windows or door openings in walls. Moreover, while preferred embodiments of the internal support structures are shown herein to have congruent members coupled to a base member to form an isosceles triangle, non-congruent members could be used without exceeding the intended scope of the invention disclosed herein. For example, a non-rectangular block might be better served by an internal structure having non-congruent members coupled to a base member.

Other embodiments of the construction block of the invention can include providing decorative features on the outer surfaces of the cast blocks. In addition, the outer surfaces of the construction component can be pre-treated during manufacture with water resistant coatings, siding, paint, layers of bonding material, as well as other technological or decorative treatments on the outer surfaces.

In further embodiments, the construction component of the invention can be manufactured with one or more layers of different filler materials in addition to the cast concrete.

In another embodiment, the construction component of the invention can be marked on the outer surfaces of the cast concrete with marks, signs, and coding, that can be read by machines for purposes of automating construction system.

As previously discussed, while the previously disclosed embodiments are shown with coupling between the interface plates as being accomplished through threaded bolts and threaded openings in the upper interface plates located at the vertex of the triangular support structure that is opposite its base, it will be appreciated by those of skill in the art that other means of fastening the construction components of the invention at their interface plates may be accomplished by other suitable means, such as structurally fusing them by welding, or by riveting them together.

Further embodiments may add additional vertical hollow channels during the manufacturing process that can be located, for example, at locations that are 25% of the length of the block from each end. When the construction components of the invention are mechanically joined in building a structure such as a wall, these hollow channels will line up as the components are staggered to provide continuous void spaces within the structure for purposes of running wiring, plumbing, and the like.

Thus, it will be appreciated by those of skill in the art that numerous benefits will be realized through construction using the various embodiments of the construction component of the invention. For example, by incorporating structural reinforcement during the manufacturing process, rather than adding it on site, the structural reinforcement components are added as part of a controlled manufacturing process in a controlled manufacturing environment, thereby increasing quality and consistency of such components. Further, by eliminating the need for such reinforcement to be performed by skilled labor on site during construction, the cost and time of construction is significantly reduced.

Additionally, the uniform reinforcement lattice that is established throughout a structure, formed by the internal support structures of the construction components as they are coupled together during construction, provides a high ratio of strength per amount of reinforcement material used. Thus, the amount of reinforcement materials deployed can be minimized for a desired strength of reinforcement, or put another way, reinforcement is maximized for a specified cost of reinforcement material.

Maximizing strength of reinforcement can be of particular importance in areas of high seismic activity. Those of skill in the art will appreciate that concrete is known to have good stress properties, but has low tension strength. This makes concrete vulnerable to catastrophic failure during high seismic activity. Thus, containment of the cast concrete within the reinforcement lattice created by the construction components of the invention as previously described, reduces the likelihood of catastrophic failure when subjected to such seismic activity.

Further, because a regular and uniform lattice-like reinforcement structure has demonstrated robust strength based on assessment models, the use of the construction components of the invention increases reliability of calculations used to determine the amount of reinforcement strength attainable for a given level of reinforcement materials to be used, the cost of custom design is reduced because the required guard-band to ensure that a given specification is met is narrower. Indeed, with the reinforcement structure contained within the construction component, it can be much more easily and accurately stress tested in a laboratory setting.

It will be appreciated that the ability to fabricate construction components with structural reinforcement built into standardized sizes and shapes ultimately reduces the cost of constructing custom designs, and lowers overall fabrication costs of the construction components themselves. This also permits easy scaling of such components to any practicable size.

Figure 11:
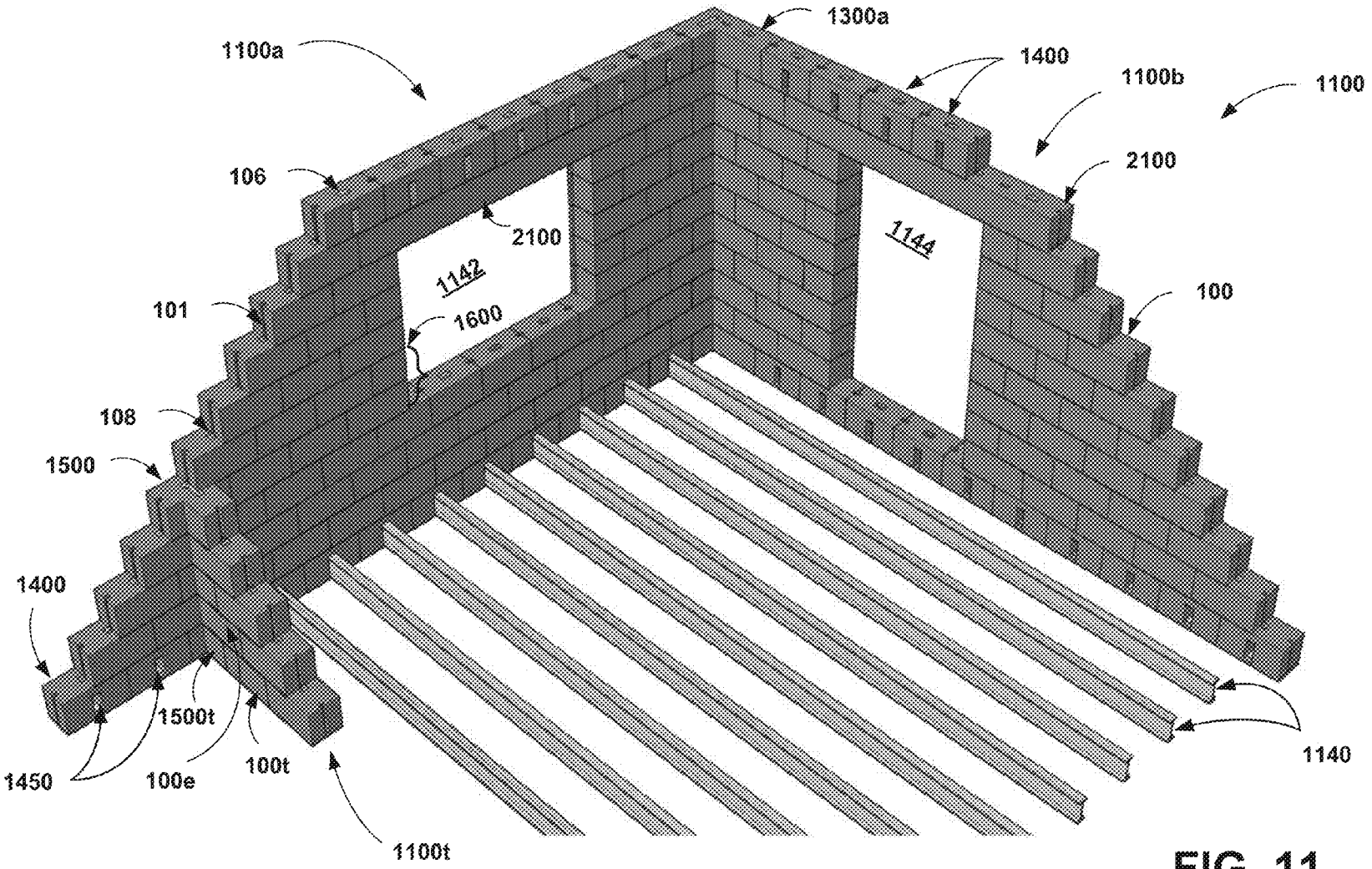
FIG. 11 illustrates a perspective view of an embodiment of a wall structure of the invention constructed of various building components of the invention.

FIG. 11 illustrates a perspective view of an embodiment 1100 of a wall structure of the invention, constructed with various embodiments of the construction components of the invention disclosed herein. Wall structure 1100 is constructed with standard construction blocks 100, FIG. 1, as well as corner blocks 1300*a, b* (FIGS. 13A and 13B), beam/joist blocks 1400 (FIG. 14), "T" blocks 1500 (FIG. 15), non-standard sized blocks 1600 (FIG. 16), and overhang blocks 2100.

It can be seen from the incomplete nature of wall structure 1100 how the standard blocks 100 fit together with each other and with embodiments of the more specialized blocks 1300, 1400, 1500 and 1600 through channels 101 providing access to attachment means 302, and attachment interface plates 106, 108 as the wall is constructed. It can also be seen how the floor beams (or floor joists not shown) 1140 may be inserted into the openings 1452 of beam blocks 1400 for supporting the beams/floor joists 1140 through the internal support structure of the beam blocks 1400, and further tying them into the entire support structure lattice 1200 as illustrated in FIG. 12.

Likewise, it can be seen how non-standard size blocks 1600 can be used to create window 1142 and door openings 1144, and overhang blocks 2100 can provide additional structural support over such openings. Finally, "T" blocks 1500 enable intersecting walls 1150 to be constructed which are also integrated into the internal support structural lattice that is created through use of the building components of the invention.

Figure 12:
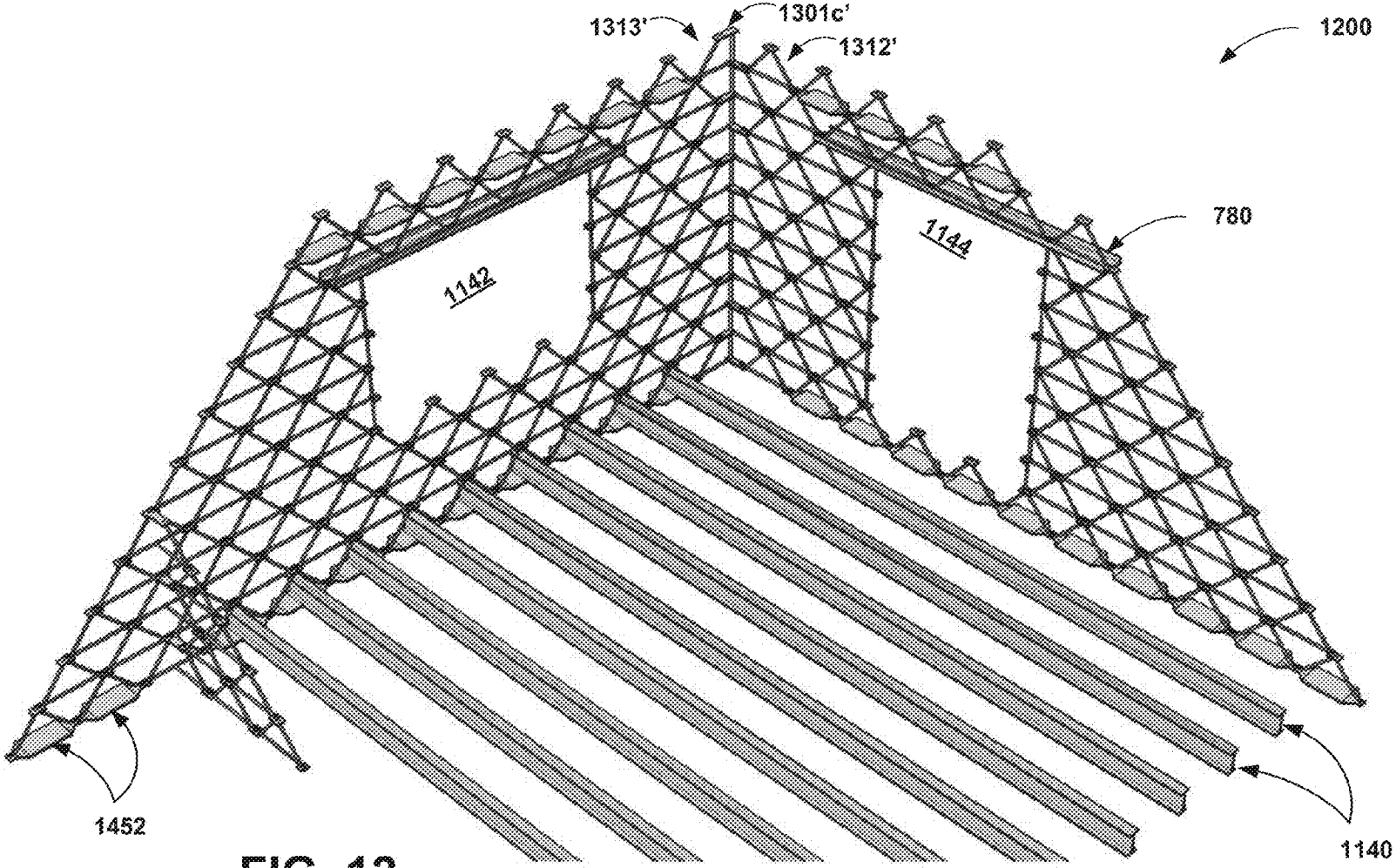
FIG. 12 illustrates a perspective view of the wall structure of FIG. 11, but with only the internal support structures of the various building components being shown to illustrate the connectivity of the internal support structures, which creates an integrated internal support lattice for the wall structure.

FIG. 12 illustrates how the internal support structures of the individual construction components are interconnected during construction to establish a support structure lattice 1200 that permeates the entire wall structure. Those of skill in the art will appreciate that this interconnected lattice 1200 is superior in providing structural support for the wall structure 1100, FIG. 11, to the more conventional technique of introducing rebar post-assembly that is largely limited to a vertical orientation. In particular, the lateral strength of the wall structure is significantly improved in view of the angled orientation of the triangular and trapezoidal reinforcement structures of the construction components of the invention. Further, those of skill in the art will appreciate that this internal support lattice is created as part of the assembly process in constructing the wall structure 1100, rather than being crudely introduced post assembly. Thus, not only is the lattice structurally superior, it is also more efficiently constructed in terms of cost and time.

Figure 13A:
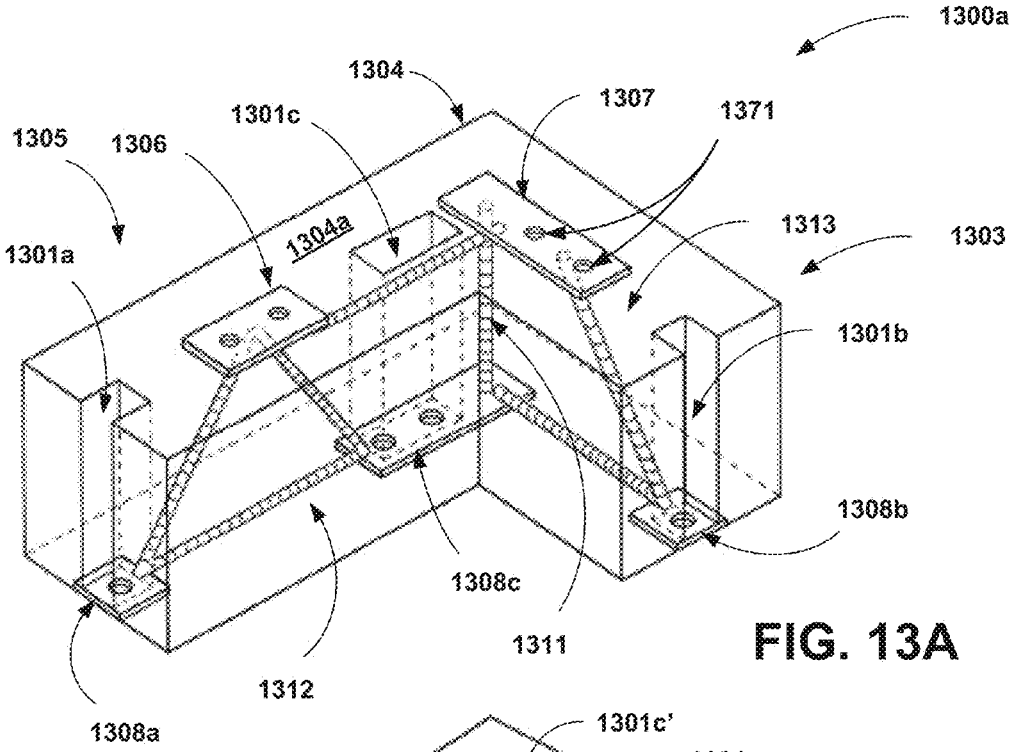
FIGS. 13A and 13B illustrate perspective views of mirrored embodiments of a corner construction component of the invention.
Figure 13B:
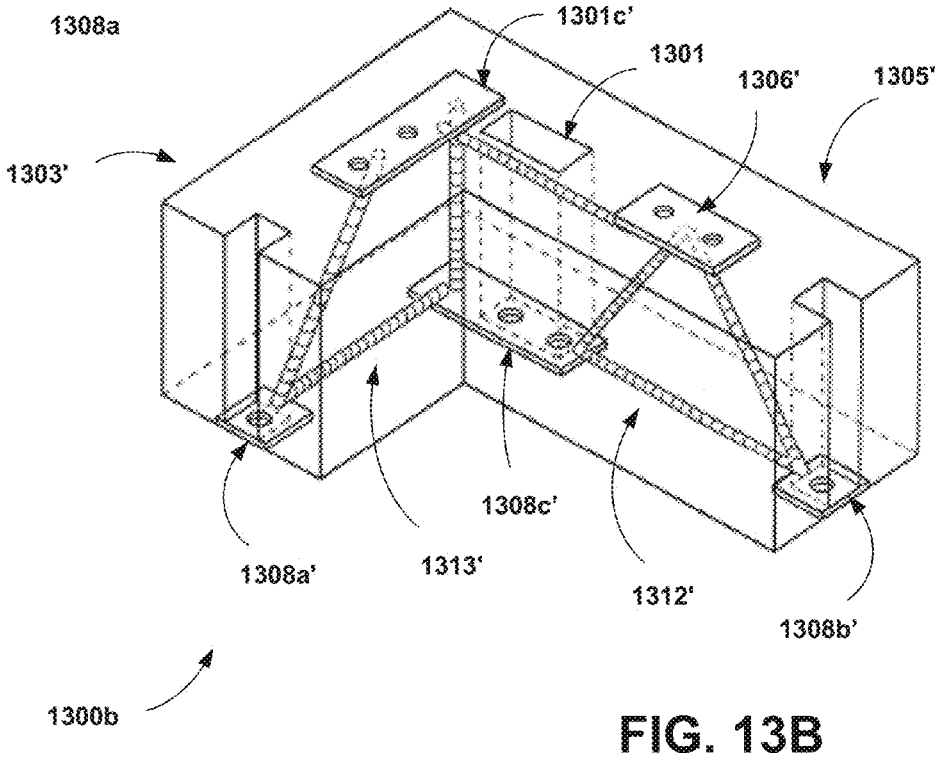

FIGS. 13A and 13B illustrate embodiments of mirrored corner construction components of the invention. The corner components are configured as two legs at right angles to one another. The length of the legs 1303, 1305 are sized asymmetrically to accommodate the alternating lengths of the overlapping blocks. This is illustrated in FIG. 11, where it can be observed that a corner is created by stacking the mirrored corner components 1300*a, b* in an alternating fashion. Internally, their asymmetric sizing does not permit a standard triangular support structure to be implemented within the shorter leg 1303, and thus the internal support structure 1313 within the shorter leg 1303 can be implemented as a trapezoidal shape. In this case, one member 1311 of structure 1313 is disposed substantially in a vertical alignment between the base interface plate 1308*c* and the elevated interface plate 1307.

Base interface plate 1308*c* can be shared between trapezoidal support structure 1313 and triangular support structure 1312 disposed in the longer of the two legs 1305. An internal vertical channel 1301*c* is provided to access shared base interface plate 1312 through the top surface 1304*a* of block 1304. Each leg 1305, 1303 has a vertical channel 1301*a*, 1301*b* by which to access base plates 1308*a* and 1308*b*.

Thus, it can be seen that in constructing a wall structure such as 1100 of FIG. 11, corner block 1300*a* of FIG. 13A can be coupled to mirrored corner block 1300*b* such that common base interface plate 1308*c* of block 1300*a* is coupled to elevated interface plate 1301*c*' as accessed through vertical channel 1301*c*. Further, base interface plate 1308*a* of block 1300*a* can then be fastened to the elevated interface plate of another construction component of the invention, such as a standard block 100, FIG. 1 in the row occupied by corner block 1300*b*. Finally, base interface plate 1308*b* can be coupled to the leftmost hole of elevated base plate 1306' of corner block 1300*b*. The rightmost or outside hole of elevated interface plate 1306' may then be coupled to a base interface plate of another building component of the invention, such as a standard block component 100, FIG. 1 that is disposed in the row occupied by corner block 1300*a*.

Figure 14:
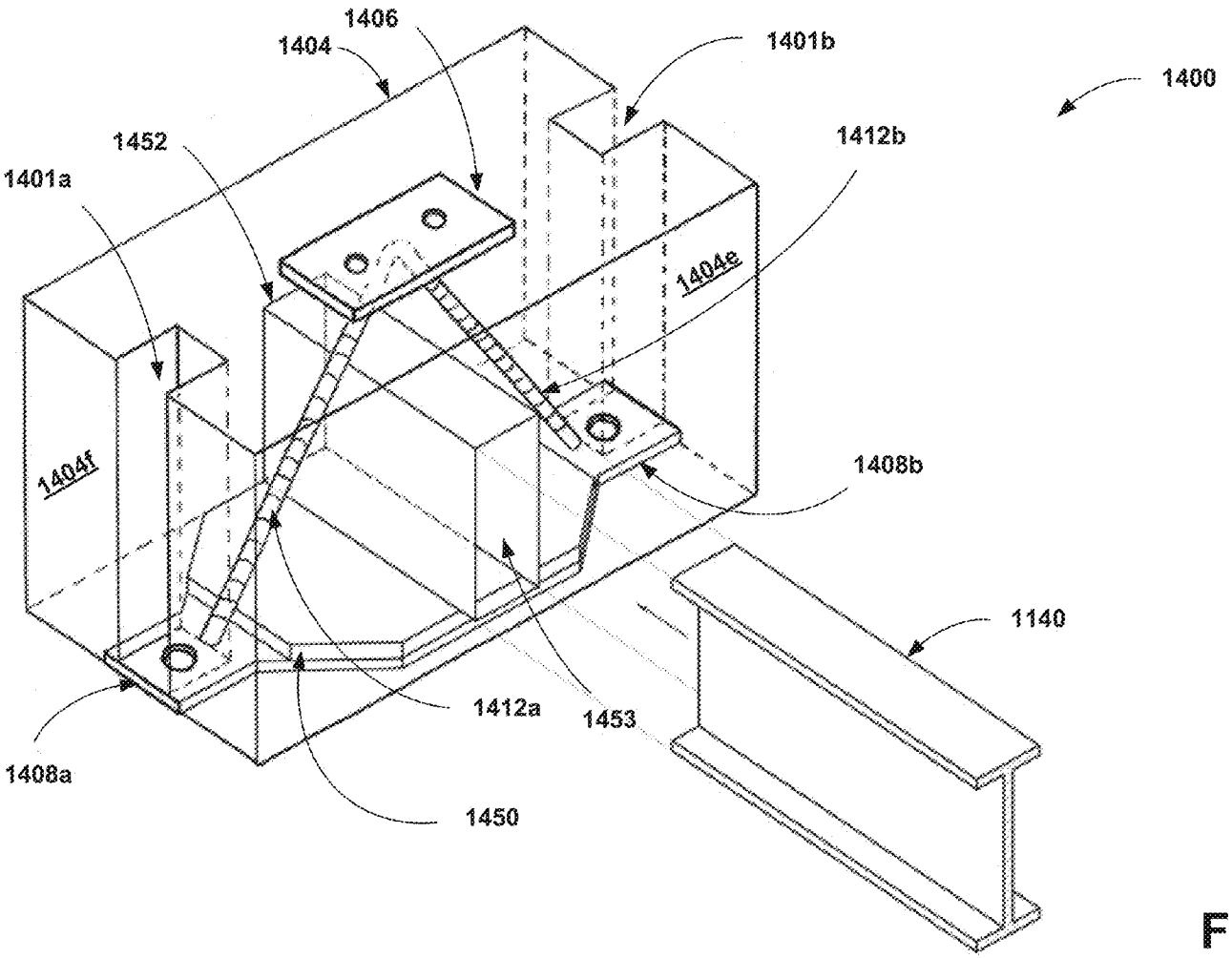
FIG. 14 illustrates a perspective view of an embodiment of a beam/joist construction component of the invention, capable of receiving and supporting beams and joists.

FIG. 14 illustrates an embodiment of a beam/joist support block 1400 that can be constructed with the same dimensions as that of standard building block 100, FIG. 1 of the invention, but has a support plate coupled between the two base interface plates 1408*a, b* to form the base member of the triangular internal support structure 1412. Thus, a beam/joist block can be substituted for a standard sized block when needed in a wall structure as illustrated in FIG. 11. Triangular support structure has two members 1412*a, b* that are each coupled between the elevated interface plate 1406 and base interface plates 1408*a* and 1408*b* respectively. Those of skill in the art will appreciate that the members 1412*a* and 1412*b* can be integral where coupled to the elevated interface plate 1406, or they may be separate and physically coupled separately thereto.

Beam/joist component 1400 also has a beam/joist access channel 1452 formed within block 1404 having an access opening in surface 1404*e*. In an embodiment, access channel 1452 can be disposed within block 1404 such that it is disposed between triangular members 1412*a, b* and further permits a beam/joist to be inserted into construction component 1400 in the orientation in which such beams/joists are commonly disposed in supporting a floor or roof and such inserted beam/joist is permitted to rest upon the support plate 1450. Support plate can be constructed of any suitable material that provides support for maintain/beam 1140 in an assembled position. Beam/joist channel 1452 can end before extending through block surface 1404*f*, or it can extend through surface 1404*f* to permit beam/joist insertion from either side of the building component 1400.

Figure 15:
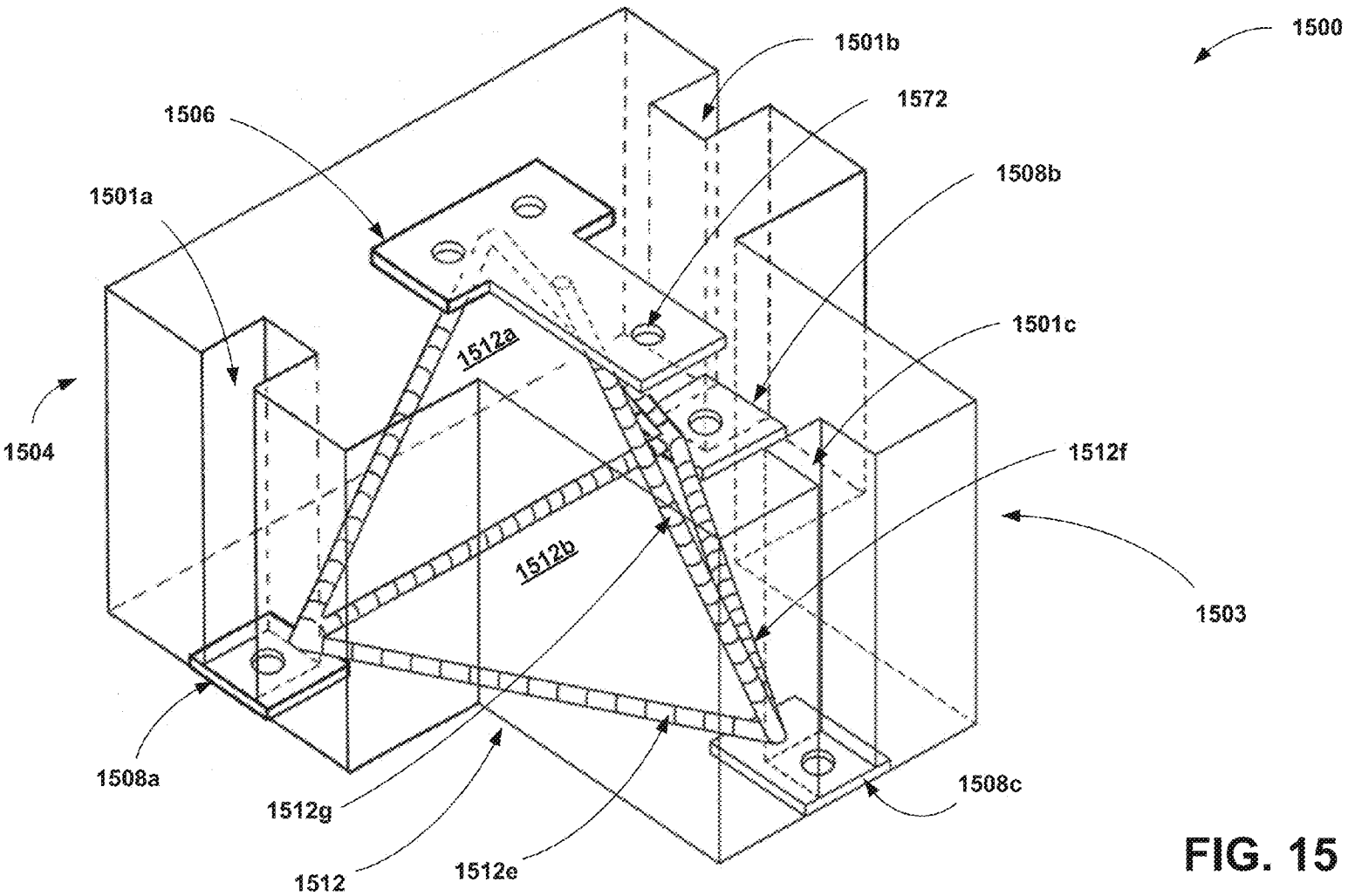
FIG. 15 illustrates a perspective view of an embodiment of a "T" construction component of the invention that facilitates construction of intersecting structural components such as walls.

FIG. 15 illustrates an embodiment of a "T" block construction component 1500 of the present invention that can be used to establish a second wall structure (e.g. 1100*t*, FIG. 11) that is perpendicular to a first wall structure (e.g. 1100*a*, FIG. 11) in which the "T" block building component 1500 is also a part. The "T" block building component includes a more complex internal support structure that includes cross-coupling of triangular structures such as is illustrated by internal support structure 812 of FIG. 8. The primary difference is that "T" block building component 1500 has three base interface plates 1508*a, b*, and *c* and one extended elevated interface plate that are cross-coupled together as illustrated in FIG. 15.

The embodiment of "T" block building component illustrated in FIG. 15 has a standard block portion 1504 and a stem portion 1503 that extends substantially in a perpendicular orientation from the standard block portion 1504. In an embodiment, stem portion 1503 extends ½ of a standard block size from the block portion 1504, and establishes the ½ stagger for the new wall 100*t* of FIG. 11. Stem portion 1503 can establish an extension from a first wall structure (e.g. 1100*a*, FIG. 11) for purposes of constructing a new second wall (e.g. 1100*t*, FIG. 11) that extends perpendicularly from the first wall structure (e.g. 1100*a*, FIG. 11), the first wall being formed in part by the block portion of "T" building component 1500. The block portion 1504 can be of the same dimensions as that of a standard building component 100, FIG. 1 of the invention, and be substituted therefore at the point where a second wall (e.g. 1100*t*, FIG. 11) is desired.

The cross-coupled internal support structure 1512 can be shared between the block portion 1504 and the stem portion 1503, and this facilitates the tying in of the second wall (e.g. 1100*t*, FIG. 11) to the internal support lattice of the overall structure (e.g. 1100, FIG. 11). The block portion 1504 includes a portion 1512*a* of the cross-coupled internal support structure that is similar to that of standard building component 100, FIG. 1, and is similarly coupled between base interface plates 1508*a, b* and elevated interface plate 1506. In this way, "T" block building component 1500 is able to be coupled with other building components like standard components 100, FIG. 1, within the first wall 1100*a* of structure 1100 as illustrated in FIG. 11.

Thus, the portion of the cross-coupled internal support structure 1512 embedded in the block portion 1504 can include an internal or embedded triangular support structure 1512*a* that is coupled between two base interface plates 1508*a, b* and an elevated interface plate 1506 as previously described for standard component 100, FIG. 1. The stem portion 1503 includes a base interface plate 1508*c*, accessible through vertical channel 1501*c*, and can share the elevated interface plate 1506 with block portion 1504, which has been elongated to extend over the stem portion and to provide an additional through-hole 1572. A second internal triangular support structure 1512*b* can be created in a plane that is substantially parallel to the bottom surface of the "T" block component 1500, by coupling stem portion base interface plate 1508*c* with base plates 1508*a, b* of block portion 1504 with members 1512 *e, f*. Additional cross-coupling is achieved by coupling base interface plate 1508*c* with elevated interface plate 1506 through additional member 1512*g*.

FIG. 11 illustrates how the "T" block building component of the invention may be used to establish a "T" intersection between two walls (e.g. between walls 1100*a* and 1100*t*). "T" block components of the invention are located in the odd numbered layers of wall 1100*a* beginning with the first layer, in lieu of standard block components 100, FIG. 1 of the invention. A standard block component 100*t*, FIG. 11 is disposed in alignment with the stem portion 1503 "T" block 1500*t*. A standard block 100*e*, FIG. 11 is then disposed over the stem portion 1503 of "T" block component 1500*t* and the first half of the standard component 100*t* in line therewith to establish the next layer or second layer of wall 1100*t*. The first base interface plate (108*a*, FIG. 1) of component 100*e* is coupled to the extended portion (extends to the stem portion 1503) of the elevated interface plate 1506, FIG. 15 of the "T" block 1500*t* (via through-hole 1572 of extended plate 1506, FIG. 15). The second base interface plate (108*b*, FIG. 1) of standard component 100*e* is coupled to the elevated base plate 106, FIG. 1 via the first through-hole 102*a*, FIG. 1 of the standard block 100*t*. The ½ stagger for the new wall is thereby established for levels one and two of the wall 1100*t*.

Figure 16:
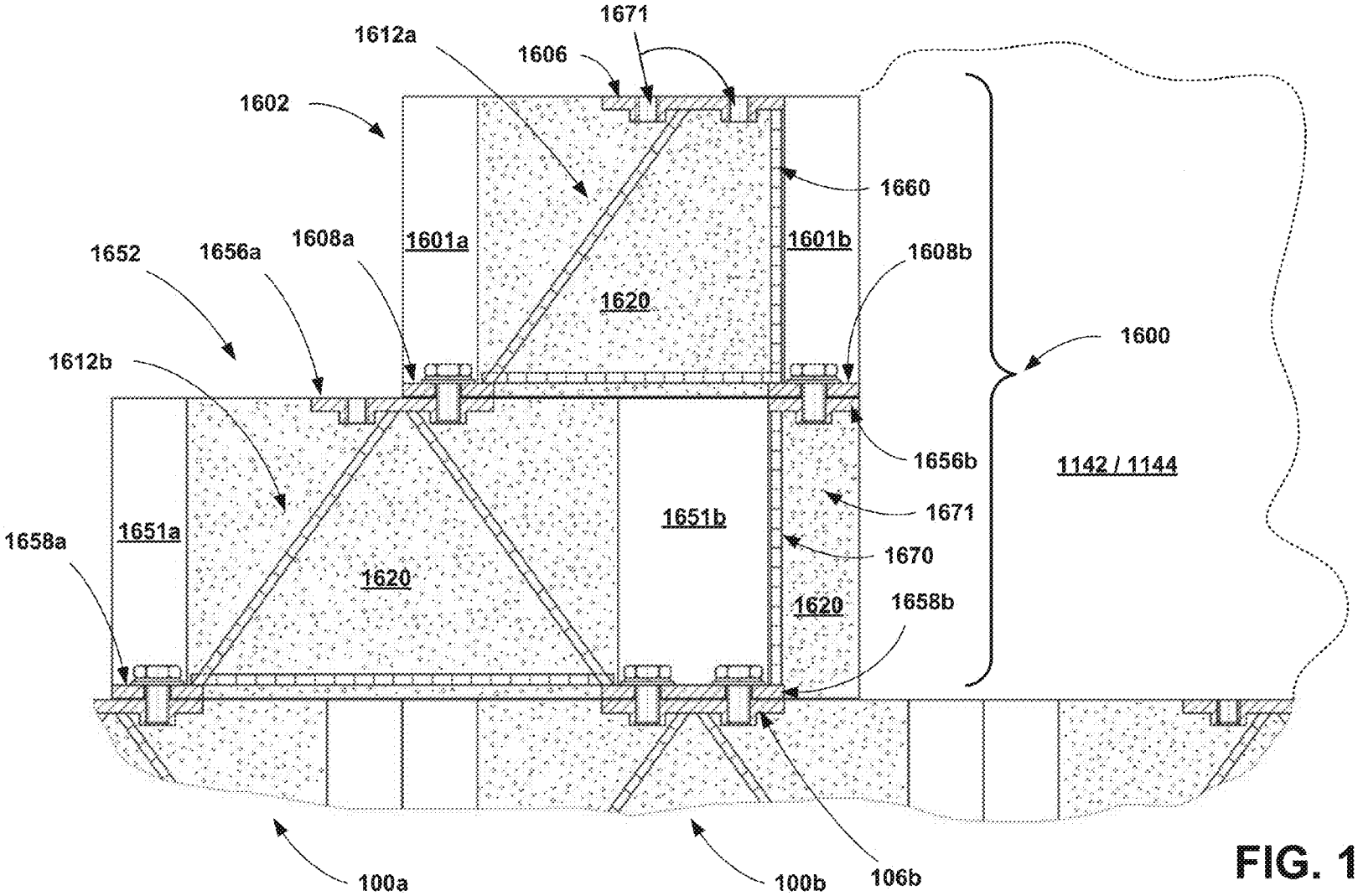
FIG. 16 illustrates a perspective view of wall structure into which an opening for a door or window has been introduced, employing construction components of the invention that are larger and smaller in dimension than standard construction components of the invention.

FIG. 16 illustrates a cross-sectional view of a portion of wall structure 1100*a* of FIG. 11 as indicated by bracket 1600. Blocks 1602 and 1652 are non-standard sized blocks that can be used to establish a non-staggered window 1142 or door opening 1144 as shown in walls 1100*a* and 1100*b* respectively of structure 1100 of FIG. 11.

In an embodiment, component 1602 is of a shorter length than standard block 100, FIG. 1 and component 1652 is a block that is longer than a standard component 100, FIG. 1 of the invention. In an embodiment component 1602 is just over half of a standard block length (e.g. ⅝ of standard length). Therefore its internal support structure 1612*a*, embedded in a solid material 1620 such as concrete, is of a trapezoidal shape that includes a vertically oriented member 1660 that is coupled between the elevated interface plate 1606 and base interface 1608*b*. In an embodiment, component 1652 is just over a full standard block length (e.g. 9/8 of standard length), and includes a triangular internal structure 1612*b* that is like that of standard sized component 100, FIG. 1, coupled between base interface plates 1658*a, b* and elevated interface plate 1656*a*.

Components 1612 and 1652 work in tandem such that they eliminate the stagger created by the overlapped standard components. As will be appreciated, component 1652 is able to span two standard sized blocks 100*a, b* as illustrated, but extends far enough beyond the second standard block 100*b* to couple to both through-holes of elevated interface plate 106*b* of standard component 100*b*, and slightly beyond to the end of vertical channel 1601*b* of component 1602. To accommodate the two through-holes, the width of vertical channel 1651*b* is twice that of a vertical channel width of a standard block 100. Additional internal reinforcement is provided by member 1670 and is vertically disposed in substantial alignment of vertical support member 1660 of component 1602, and is coupled between base interface plate 1656*b* and elevated interface plate 1608*b*. Component 1652 then extends an additional length substantially equal to a vertical channel width by way of concrete portion 1671, which supports elevated interface plate 1656*b*.

Those of skill in the art will appreciate that when the component 1602, which is ⅝ of a standard block length, is coupled to component 1652, which is 9/8 of the standard block length, a ⅜ or ½ block length is presented over component 1652 by which to receive a half staggered standard block (not shown). This relationship is illustrated in FIG. 11 and is the difference between the larger block and the smaller block (i.e. 9/8−⅝=½) Those of skill in the art will appreciate that the non-standard blocks can be made with any ratio of sizes provided that their difference in length is equal to ½. For example, blocks of 5/4 and ¾ or 19/16-11/16 will also work, as the difference between the longer non-standard block and the smaller non-standard block equals ½.

Figure 17:
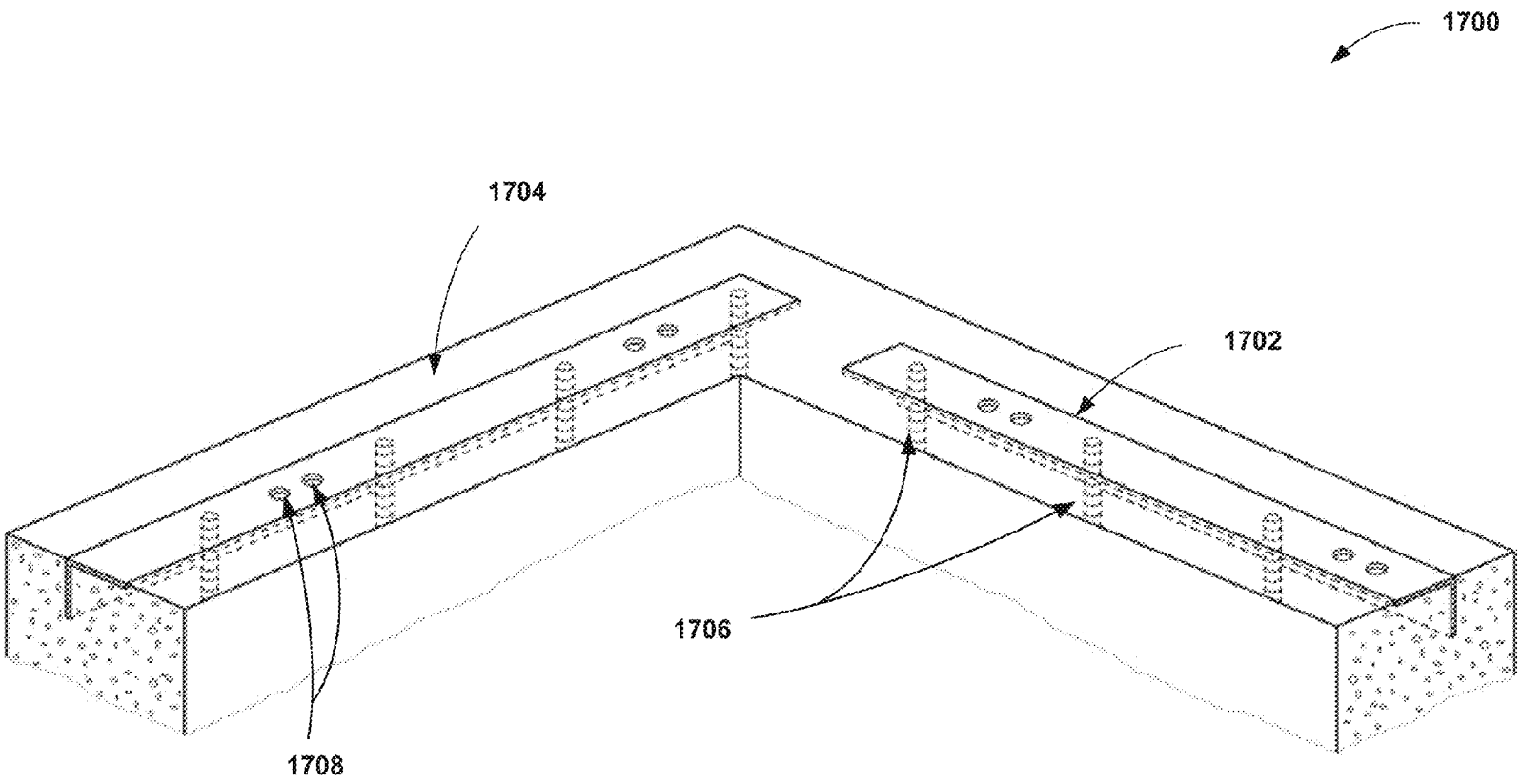
FIG. 17 illustrates a perspective view of an embodiment of a foundation interface construction component of the invention that permits the use of the building components of the invention with a standard interface.

FIG. 17 illustrates an embodiment of a foundation interface component 1700 of the invention by which a foundation can be adapted to interface with the various building components and thereby tying the internal support lattice of an entire structure to the foundation. L-shaped metal bars 1702, 1704 are disposed in concrete and secured with concrete screws 1706. Through holes 1708 are located in the L-shaped metal bars and thus the first row of blocks, such as beam/joist component blocks 1400 and corner block components of the invention can be tied through their respective base interface plates to the foundation, thereby tying the entire internal support lattice directly to the foundation.

Figure 18A:
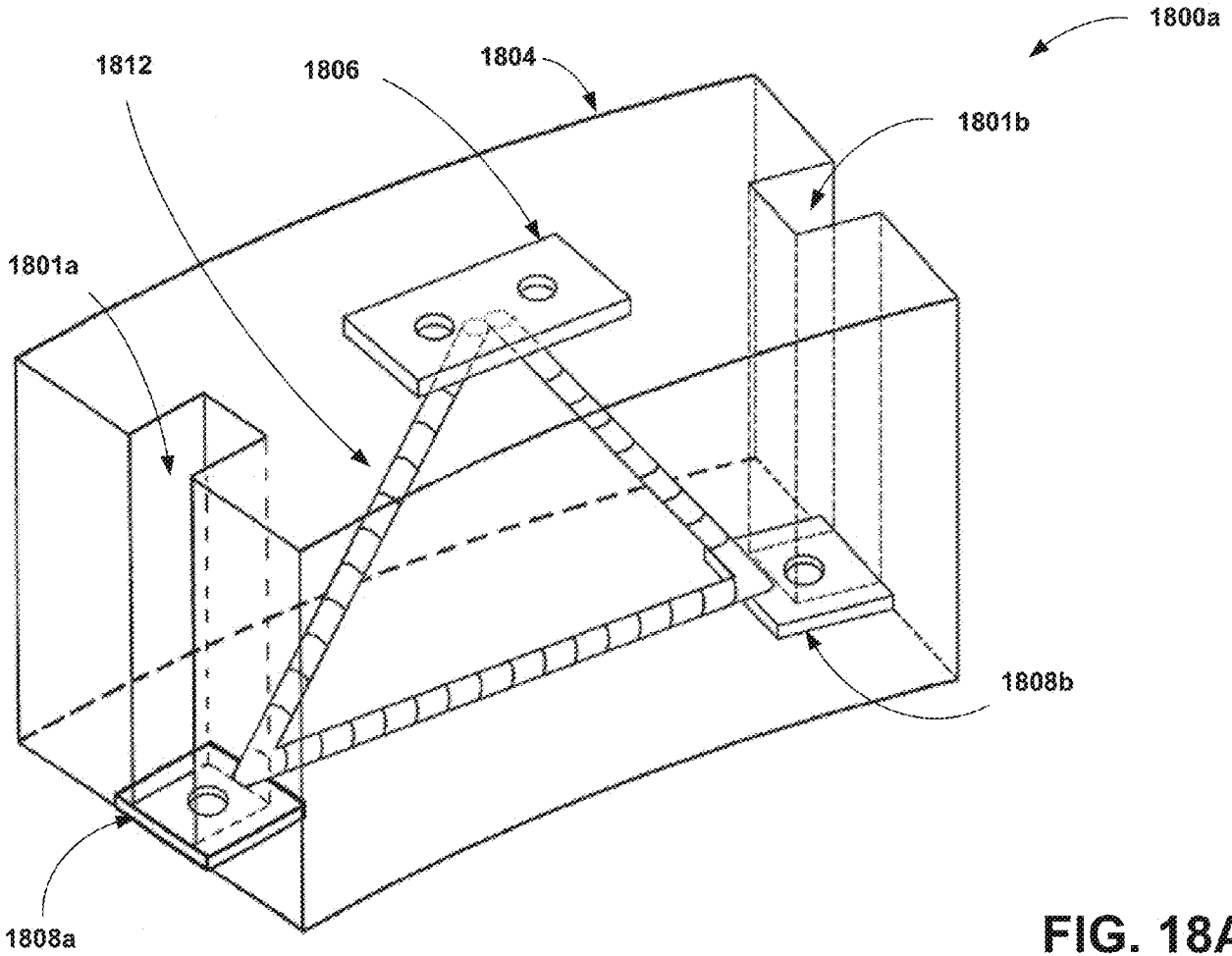
FIG. 18A illustrates a perspective view of an embodiment of a curved construction component of the invention that permits the use of the building components of the invention to create curved wall structures.

FIG. 18A illustrates an embodiment of a non-standard building component 1800*a* of the invention wherein the concrete is formed with curved surfaces to effectuate the construction of non-rectangular wall structures. The component 1800*a* has a similar internal structural support structure 1812 that is coupled between base interface plates 1810*a, b* and elevated interface plate 1806.

Figure 18C:
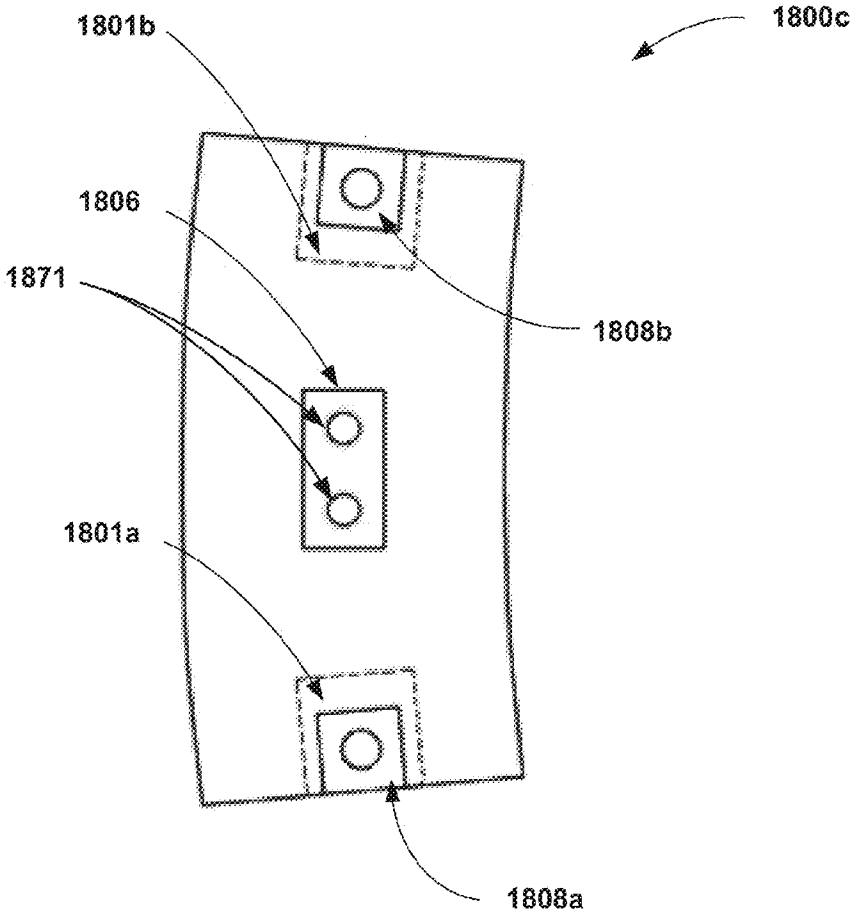
FIGS. 18B and 18C illustrate top plan views of embodiments of the curved construction component of FIG. 18, that are curved at one end or at both ends, respectively.
Figure 18B:
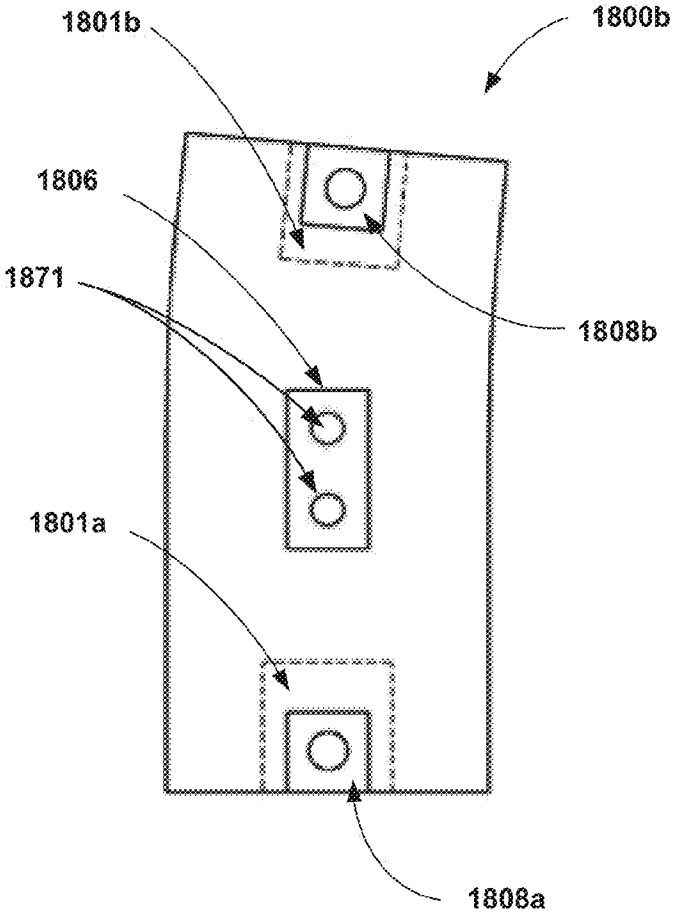

FIG. 18B illustrates a plan view of the top of an embodiment of a curved building component 1800*b* of the invention that is straight at one end and curved at the other, while FIG. 18C illustrates a plan view of the top of an embodiment of a curved building component 1800*c* of the invention that is curved at both ends.

Figure 19:
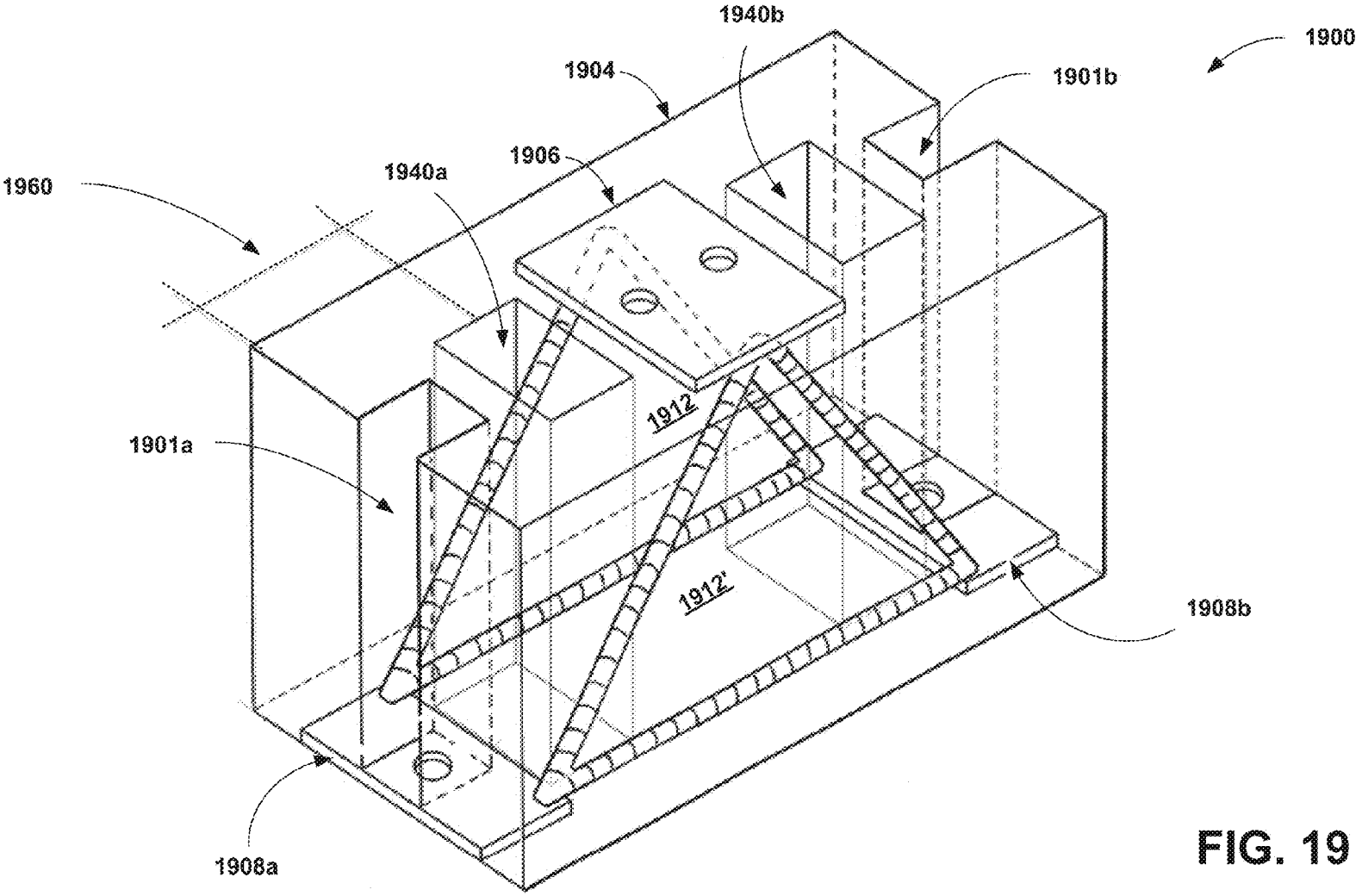
FIG. 19 illustrates a perspective view of an embodiment of a construction component of the invention that is similar to the standard construction block of the FIG. 1, but has two triangular shaped internal reinforcement structures to support and provide room for vertical channels through which plumbing, wiring and the like may be disposed within a wall structure.

FIG. 19 illustrates an embodiment of a building component 1700 of the invention that includes internal vertical channels 1940*a, b* that are aligned as a wall structure is constructed, and permits the running of plumbing and electrical conduits throughout the structure. The center line of each internal vertical channel is ¼ of the length of the block to the end 1960, which ensures that when the blocks are overlapped by ½, the internal vertical channels will align throughout the entire structure. Triangular internal support structure 1912 is moved from the center of the block 1904 and is then doubled to two triangular support structures 1912 and 1912' as shown. The two internal support structures are coupled between shared base interface plates 1908*a, b* (accessed through vertical channels 1901*a, b* during assembly), and elevated interface plate 1906. By moving the internal support structure to the outer portion of block 1904, room is created for the internal vertical channels 1940*a, b*. By doubling the internal support structure, the loss in stability created when moving the support structure off of the center line is at least partially offset.

FIG. 11 further discloses an overhang building component 2100 that can be used to further structurally reinforce door 1144 and window 1142 openings. Overhang component 2100 can be made virtually any size as required and can have a repeatable interface structure such as the one 712 disclosed in FIG. 7, depending upon the number of, for example, standard sized components that it must span. U-shaped steel bar 780 provides the additional structural reinforcement for the wall structure in which it is deployed. The steel bar 780 can be seen in the structural lattice of FIG. 12.

Those of skill in the art will appreciate that through the pre-fabrication of the various building blocks of the invention, having embedded therein an internal support structure having interface plates accessible at the upper and lower surfaces, wall structures and the like can be easily constructed that form a fully integrated reinforcement lattice that permeates the entire structure and that can be coupled directly to the foundation. Because the building components are prefabricated with the internal support structures, no additional steps are required during construction to insert reinforcement, as is the case with conventional reinforcement techniques. Moreover, introduction of rebar reinforcement using conventional techniques during construction severely limits the quality of the reinforcement because the rebar is rendered only in a vertical orientation. The lattice quality of the reinforcement ensures strong reinforcement against stresses produced on the structure from multiple directions, and that such stresses are distributed throughout the lattice.

What is claimed is:

1. A construction component having embedded internal structural reinforcement, the internal structural reinforcement configured to be directly coupled to the internal reinforcement of others of said construction component, said construction component comprising:

an internal support structure, the support structure including:

at least one triangular structure, the at least one triangular structure including:

a base member and two side members; and a first and a second base vertex, each formed between a first end of each of the side members and opposite ends of the base member respectively; and at least one elevated interface plate, rigidly coupled to a second end of each of the side members of the at least one triangular structure; and a first and a second base interface plate, each rigidly coupled to the first base vertex and second base vertex respectively; and a masonry block substantially encapsulating the internal support structure therein, wherein the elevated interface plate of the internal support structure is exposed through a top surface of the masonry block, and the first and second base interface plates are exposed through a bottom surface of the masonry block, and wherein the elevated interface plate of the construction component is configured to be mechanically coupled to one of the base interface plates of each of at least two others of said construction component to securely couple said construction components together in a staggered manner.

2. The construction component of claim 1, wherein at least some of the members of the internal support structure are composed of steel rebar and the masonry block is composed of concrete.

3. The construction component of claim 1 having a standard configuration wherein the masonry block is substantially rectangular in shape and has a standardized length, the at least one triangular structure being disposed in a plane that is oriented axially with, and the base member and base interface plates together substantially spanning the, the masonry block's standardized length.

4. The construction component of claim 3 further including a beam channel, accessible through an opening in at least one side surface of the masonry block, the beam channel being oriented perpendicularly to, and extending substantially through, the plane in which the support structure is disposed, the beam channel being located between the base interface plates, the beam channel and opening being configured to receive and support an end of a beam member within the masonry block.

5. The construction component of claim 4 further including a support plate, disposed substantially at the bottom of the masonry block between the base interface plates and intersecting the beam channel, the support plate configured to support a beam member inserted into the beam channel.

6. The construction component of claim 3, wherein the at least one triangular support structure is substantially upright in orientation and perpendicular with the top and bottom surfaces of the masonry block.

7. The construction component of claim 3 wherein the masonry block of the component has a standard configuration and has the dimensions of a CMU (concrete masonry unit), and the at least one triangular structure is disposed in a centered plane within the masonry block, the centered plane being oriented axially with the longest dimension of the masonry block.

8. The construction component of claim 3 wherein the internal support structure includes an extension to the at least one triangular structure of the standard configuration, the extension configured to extend additional structural support to portions of the masonry block when the block deviates from the standard configuration, the extension including at least one extension member coupled at a first end to at least one extension base plate, the extension member being coupled at a second end to at least one of: the elevated base plate or an extension elevated base plate.

9. The construction component of claim 8, wherein the masonry block includes:

a rectangular block portion and a stem portion, the at least one triangular structure being disposed in the rectangular block portion in a plane that is oriented axially with the block portion's length; and a stem portion extending perpendicularly from a side surface of the block portion;

wherein the extension of the triangular structure extends into the stem portion, the extension sharing the elevated interface plate of the at least one triangular support structure, the extension including an extension base vertex, the third base vertex coupled through a first and second extension member to the first and second base vertices of the triangular structure, a third extension member being coupled between the extension base vertex and the shared elevated interface plate.

10. The construction component of claim 9 wherein the block portion is of the standardized length of the standard configuration, and the stem portion is one half the standardized length of the standard configuration.

11. The construction component of claim 8, wherein the masonry block is "L" shaped, having asymmetrically sized first and second legs, joined at a right angle, to accommodate alternating lengths of overlapping construction components at a corner between two walls.

12. The construction component of claim 8 wherein the masonry block includes at least a first and second vertical channel, each extending from the top surface to the bottom surface of the masonry block, and the vertical channels being disposed over all base and extension base interface plates to provide access to the base and extension base interface plates from the top surface, whereby mechanical coupling of each of the exposed base and extension base interface plates to the elevated interface plates of others of said construction components is facilitated.

13. The construction component of claim 12, wherein the base and extension base interface plates include at least one opening there through, each of the vertical channels disposed directly over the at least one opening of each of the base and extension base interface plates.

14. The construction component of claim 12 wherein:

the internal support structure includes two of the triangular structures disposed substantially in parallel with one another, the two triangular structures being disposed in a plane that is oriented axially with the masonry block's length, the two triangular structures share the same base plates, the masonry block includes at least a first and second vertical channel disposed over the shared base interface plates.

15. The construction component of claim 14, wherein the masonry block further includes at least one internal vertical channel, the vertical channel extending between the top and bottom surfaces of the masonry block and configured to line up with internal vertical channels of others of the construction units of the invention with which it is mechanically coupled, the aligned vertical channels configured to receive wiring or plumbing components running vertically within a structure built therewith. first and second base plates of each of the two triangular structures are formed of a single U-shaped bar.

16. The construction component of claim 15, wherein the masonry block is a of the standardized length of the standard configuration, and the at least one internal vertical channel is located ¼ of the standardized length inward from an end of the masonry block to ensure alignment when coupled together in a staggered manner.

17. The construction component of claim 14 , wherein the two parallel triangular structures are disposed sufficiently apart from on another within the masonry block to accommodate the at least one internal vertical channel therebetween.

18. The construction component of claim 1, wherein the masonry block is curved so that end surfaces of the masonry block are not in parallel planes.

19. The construction component of claim 18 wherein only half of the masonry block is curved.

20. A construction component having embedded internal structural reinforcement, the internal structural reinforcement configured to be directly coupled to the internal reinforcement of others of said construction component, said construction component comprising:

an internal support structure, the support structure including:

at least two triangular structures, the at least two triangular structures each including:

a base member and two side members; and a first and second base vertex, each formed between a first end of each of the side members and opposite ends of the base member respectively; and an elevated vertex formed by an intersection of second ends of the first and second side members at a location above the base member; and at least one member cross-coupled between a first and second one of the at least two triangular structures;

at least one elevated interface plate being rigidly coupled substantially at the elevated vertex of each of the at least two triangular structures; and at least one first and at least one second base interface plate, the at least one first base interface plate being coupled substantially at the first base vertex of each of the at least two triangular structures, and the at least one second base interface plate being coupled substantially at the second base vertex of each of the at least two triangular structures; and a masonry block substantially encapsulating the internal support structure therein, the at least one elevated interface plate of the internal support structure being exposed through a top surface of the masonry block, the at least one first and the at least one second base interface plates being exposed through a bottom surface of the masonry block, and wherein the at least one elevated interface plate of said construction component is configured to be mechanically coupled to one of the at least one base interface plates of each of at least two others of said construction component to securely couple said construction components together in a staggered manner.

21. The construction component of claim 20, wherein a first and second of the at least two triangular structures are disposed in planes that are substantially in parallel with one another.

22. The construction component of claim 20, wherein the at least one cross-coupled member is coupled substantially between the elevated vertex of each of the first and second ones of the at least two triangular structures.

23. The construction component of claim 20, wherein the cross-coupled member is coupled substantially between the elevated vertex of the first one of the at least two triangular structures and at least one of the two base vertices of the second one of the at least two triangular structures.

24. The construction component of claim 20, wherein the at least one cross-coupled member is coupled substantially between at least one of the base vertices of the first one of the at least two triangular structures, and at least one of the two base vertices of the second one of the at least two triangular structures.

25. The construction component of claim 20, wherein:

the masonry block includes a thermally resistant layer that substantially divides the masonry block into at least two substantially discrete masonry sections, and the first and second of the at least two triangular structures are each encapsulated within a different one of the masonry sections.

26. The construction component of claim 25, wherein the at least one cross-coupled member is part of a cross-coupling component that is coupled substantially between the first members of each of the first and second ones of the at least two triangular structures to provide cross-coupling between the elevated vertex of the first one of the at least two triangular structures and the first base vertex of the second one of the at least two triangular structures, and vice versa.

27. The construction component of claim 26, wherein the cross-coupling component further includes members that provide cross-coupling between the elevated vertices of the first and second ones of the at least two triangular structures, and between each of the first base vertices of the first and second ones.

28. The construction component of claim 27, wherein the at least one cross-coupled member spans the thermally resistant layer of the masonry block between the first and second ones of the at least two triangular structures.

29. The construction component of claim 28, wherein:

the base member and two side members of the first and second ones of the at least two triangular structures are made of thermally conductive metal, and the cross-coupled member is made of a thermally resistant material.

30. The construction component of claim 20 wherein the masonry block includes at least a first and second vertical channel, each extending from the top surface to the bottom surface of the masonry block, and disposed over the base interface plates to provide access to the base interface plates from the top surface to facilitate mechanical coupling of each of the exposed base interface plates to the elevated interface plates of others of said construction components.

31. A wall structure having embedded therein an internal structural reinforcement lattice, the internal structural reinforcement lattice configured to be directly coupled to a foundation, said wall structure comprising:

a plurality of pre-fabricated structural components, each of the pre-fabricated structural components comprising:

an internal support structure, the support structure including one or more elevated interface plates and one or more base interface plates; and a masonry block substantially encapsulating the internal support structure therein, wherein:

the one or more elevated interface plates of the internal support structure are exposed through a top surface of the masonry block, and the one or more base interface plates are exposed through a bottom surface of the masonry block, and the masonry block includes one or more vertical channels, each extending from the top surface to the bottom surface of the masonry block, and each disposed over the one or more base interface plates to provide access to the base interface plate from the top surface, and wherein at least some of the plurality of construction components are of a standard configuration in which:

the masonry block is rectangular and has a standardized length, and includes two of the one or more vertical channels disposed over the at least one base plate, each of the channels located proximately to each end of the rectangular block, and the internal structure is triangular and includes first and second base vertices that are each rigidly coupled to the one or more base plates, and an elevated vertex rigidly coupled to the one or more elevated interface plates, and wherein the one or more elevated interface plates of each of the plurality of construction components is configured to be mechanically coupled, by way of the access provided by the one or more vertical columns, to the at least one of the base interface plates of each of at least two others of the plurality, thereby securely coupling said plurality of construction components together to form the wall structure and to establish the integrated reinforcement lattice therein.

32. The wall structure of claim 31, wherein the internal support structure of the plurality of structural components is composed of steel rebar.

33. The wall structure of claim 31 wherein at least some of the plurality of structural components have a different configuration that differs from the standard configuration, the internal support structure of the different configuration further including an extension to the at least one triangular structure of the standard configuration, the extension configured to provide additional structural support for certain portions of the masonry block.

34. The wall structure of claim 33 wherein:

the extension includes at least one member, coupled at a first end to at least one of the one or more base plates that forms an at least one extension base plate, the at least one extension member coupled at a second end to at least one of the one or more elevated interface plates that forms an at least one extension elevated interface plate, and at least one of the one or more vertical channels is disposed over the at least one extension base plate.

35. The wall structure of claim 34, wherein each of the one or more base interface plates of the structural components includes at least one opening there-through, each of the vertical channels being disposed directly over one of the openings of one of the one or more base interface plates.

36. The wall structure of claim 35 wherein:

each one of the one or more elevated interface plates includes at least one threaded opening, and the at least one opening of each of the one or more base interface plates of a first one of said structural components is configured to be aligned with the at least one threaded opening of one of the elevated interface plates of a second one of said structural components, whereby a threaded bolt can be inserted through the at least one opening of the base interface plate of the first one of the components and screwed into the at least one opening in the elevated interface plate of the second one of the components to mechanically couple the first one and second one of said structural components together.

37. The wall structure of claim 33 wherein the at least some of the components having the different configuration are a "T" block component, the "T" block component including:

a standard block portion having the standard configuration, and a stem portion, formed integrally with the standard block portion, extending perpendicularly from a side of the standard block portion, the stem portion having a length that is equivalent to one half of the standardized length of the standard block portion, the stem portion configured to accommodate a second wall perpendicular to said wall structure.

38. The wall structure of claim 33 wherein at the least some of the components having the different configuration are first and second corner block components, the first and second corner block components including:

a standard block portion having the first configuration, and a second block portion that is one half of the first block portion, the second block portion formed integrally with the first block portion and having a length of one half of the standardized length, the second block extending perpendicularly as part of one end of the first block portion to form a right angle and a shared corner therewith wherein the second block portion of the first corner block component extends from a first end of the first block portion, and wherein the second block portion of the second corner block component extends from a second end of the first block portion, thereby rendering the first and second corner block components mirror images of one another, whereby stacking the first and second corner block components vertically in an alternating fashion creates a corner between said wall structure and a second wall structure that accommodates the alternating staggered levels of adjacent rows of said wall structure and adjacent walls of the second wall coupled thereto.

39. The wall structure of claim 31 wherein at least some of the plurality of structural components have a different configuration that differs from the standard configuration, the different configuration including the masonry block having at least one curved surface include at least one curved surface.

40. The wall structure of claim 31 wherein at least some of the components having the standard configuration include a channel formed therein to receive and internally support a beam or joist member.

41. The wall structure of claim 31 wherein at least one of the plurality of pre-fabricated structural components is an differs that deviates from the standard configuration in that it spans a window or door opening in said wall structure that is greater than the standardized length, of the standard configuration the overhang block component having a plurality of the at least one triangular internal support structures of the standard configuration, the plurality of triangular support structures having a common base member that is a metal bar spanning the length of the masonry block of the overhang block component.

42. The wall structure of claim 31 wherein:

at least some of the components have a first configuration that is different from the standard configuration, the first configuration including:

a masonry block having a length that is less than the standardized length of the standard configuration, and an internal support structure that includes a truncated triangular support structure to accommodate the lesser length, and at least some of the components having a second configuration that is different than the standard configuration, the second different configuration including;

a masonry block having a length that is greater than the standardized length of the standard configuration, and an internal support structure that includes the triangular support structure of the standard configuration and an extension thereto to accommodate the greater length whereby when a first component having the first different configuration is vertically stacked atop a second component having the second different configuration, and the difference between the greater length of the second component and the lesser length of the second component, the staggered relationship between the rows is accommodated to establish part of a rectangular opening in said wall structure.

* * * * *